US011648784B2

(12) United States Patent
Herrmann et al.

(10) Patent No.: US 11,648,784 B2
(45) Date of Patent: May 16, 2023

(54) DEVICES, SYSTEMS, AND METHODS FOR SUPPLYING MAKEUP AIR THROUGH OPENINGS IN CARRIER PLATES OF PRINTING SYSTEM VIA AN AIR GUIDE STRUCTURE

(71) Applicant: XEROX CORPORATION, Norwalk, CT (US)

(72) Inventors: Douglas K. Herrmann, Webster, NY (US); Jason M. LeFevre, Penfield, NY (US); Chu-Heng Liu, Penfield, NY (US); Paul J. McConville, Webster, NY (US); Seemit Praharaj, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 17/216,232

(22) Filed: Mar. 29, 2021

(65) Prior Publication Data

US 2022/0305817 A1 Sep. 29, 2022

(51) Int. Cl.
*B41J 29/38* (2006.01)
*B41J 11/00* (2006.01)

(52) U.S. Cl.
CPC ..... *B41J 11/0085* (2013.01)

(58) Field of Classification Search
None
See application file for complete search history.

(56) References Cited

U.S. PATENT DOCUMENTS 6,719,398 B1 * 4/2004 McElfresh ..... B41J 2/04586 347/34
8,388,246 B2 3/2013 Spence et al.
(Continued)

FOREIGN PATENT DOCUMENTS

EP 1 319 510 B1 9/2009
GB 2 374 834 A 10/2002
(Continued)

OTHER PUBLICATIONS

Co-Pending U.S. Appl. No. 17/216,175, "Devices, Systems, and Methods for Supplying Wakeup Air Through Openings in Carrier Plates of Printing System,", filed Mar. 29, 2021.
Co-Pending U.S. Appl. No. 17/216,192, "Devices, Systems, and Methods for Supplying Wakeup Air Through Openings in Carrier Plates of Printing System and Directing the Air Under the Carrier Plate,", filed Mar. 29, 2021.
(Continued)

*Primary Examiner* — Erica S Lin
*Assistant Examiner* — Tracey M McMillion
(74) *Attorney, Agent, or Firm* — Jones Robb, PLLC

(57) ABSTRACT

A printing system comprises a print fluid deposition assembly, a media transport device, and an air flow control system. The print fluid deposition assembly comprises a printhead to eject a print fluid through an opening of a carrier plate to a deposition region. The media transport device holds a print medium against the movable support surface by vacuum suction and transports the print medium through the deposition region. The air flow control system comprises an air supply unit to selectively flow air through the opening based on a location of a print medium relative to the printhead. The air supply unit comprises an air guide structure comprising an air outlet portion extending into the opening of the carrier plate between the printhead and the carrier plate, the air outlet portion terminating in an end wall that is angled obliquely relative to the movable support surface towards a reverse-process direction.

20 Claims, 22 Drawing Sheets

(56) References Cited

U.S. PATENT DOCUMENTS

| | | | | |
|---|---|---|---|---|
| 9,944,094 | B1 | 4/2018 | Herrmann et al. | |
| 10,688,778 | B2 | 6/2020 | Fromm et al. | |
| 2002/0158937 | A1 | 10/2002 | Pietrzyk et al. | |
| 2010/0188455 | A1 | 7/2010 | Shinkawa et al. | |
| 2010/0208018 | A1 | 8/2010 | Snyder et al. | |
| 2017/0129252 | A1* | 5/2017 | Barnett | B41J 2/04516 |
| 2018/0339529 | A1* | 11/2018 | Zirilli | B41J 11/0085 |
| 2020/0269585 | A1 | 8/2020 | Izawa et al. | |

FOREIGN PATENT DOCUMENTS

| | | | | |
|---|---|---|---|---|
| JP | 2016183046 | A | 10/2016 | |
| WO | WO-2015200464 | A1 * | 12/2015 | B41J 2/04516 |

OTHER PUBLICATIONS

Co-Pending U.S. Appl. No. 17/216,211, "Devices, System, and Methods for Supplying Wakeup Air At Printhead Modules of a Printing System,", filed Mar. 29, 2021.

Co-Pending U.S. Appl. No. 17/216,245, "Devices, Systems, and Methods for Supplying Wakeup Air Through Ports in a Carrier Plate of a Printing System,", filed Mar. 29, 2021.

Co-Pending U.S. Appl. No. 17/216,261, "Devices, Systems, and Methods for Supplying Wakeup Air Through Openings in Carrier Plates of Printing System Via Air Guide Structures Extending Into the Openings,", filed Mar. 29, 2021.

Cross-cited U.S. Appl. No. 17/216,192, Office Action dated May 17, 2022.

* cited by examiner

DEVICES, SYSTEMS, AND METHODS FOR SUPPLYING MAKEUP AIR THROUGH OPENINGS IN CARRIER PLATES OF PRINTING SYSTEM VIA AN AIR GUIDE STRUCTURE

FIELD

Aspects of this disclosure relate generally to inkjet printing, and more specifically to inkjet printers having a media transport device utilizing vacuum suction to hold print media. Related devices, systems, and methods also are disclosed.

INTRODUCTION

In some applications, inkjet printing systems use an ink deposition assembly with one or more printheads, and a media transport device to move print media (e.g., a substrate such as sheets of paper, envelopes, or other substrate suitable for being printed with ink) through an ink deposition region of the ink deposition assembly (e.g., a region under the printheads). The inkjet printing system forms printed images on the print media by ejecting ink from the printheads onto the media as the media pass through the deposition region. In some inkjet printing systems, the media transport device utilizes vacuum suction to assist in holding the print media against a movable support surface (e.g., conveyor belt, rotating drum, etc.) of the transport device. Vacuum suction to hold the print media against the support surface can be achieved using a vacuum source (e.g., fans) and a vacuum plenum fluidically coupling the vacuum source to a side of the moving surface opposite from the side that supports the print medium. The vacuum source creates a vacuum state in the vacuum plenum, causing vacuum suction through holes in the movable support surface that are fluidically coupled to the vacuum plenum. When a print medium is introduced onto the movable support surface, the vacuum suction generates suction forces that hold the print medium against the movable support surface. The media transport device utilizing vacuum suction may advantageously allow print media to be securely held in place without slippage while being transported through the ink deposition region under the ink deposition assembly, thereby helping to ensure correct locating of the print media relative to the printheads and thus more accurate printed images. The vacuum suction may also advantageously allow print media to be held flat as it passes through the ink deposition region, which may also help to increase accuracy of printed images, as well as helping to prevent part of the print medium from rising up and striking part of the ink deposition assembly and potentially causing a jam or damage.

One problem that may arise in inkjet printing systems that include media transport device utilizing vacuum suction is unintended blurring of images resulting from air currents induced by the vacuum suction. In some systems, such blurring may occur in portions of the printed image that are near the edges of the print media, particularly those portions that are near the lead edge or trail edge in the transport direction of the print media. During a print job, the print media are spaced apart from one another on the movable support surface as they are transported through the deposition region of the ink deposition assembly, and therefore parts of the movable support surface between adjacent print media are not covered by any print media. Thus, adjacent to both the lead edge and the trail edge of each print medium there are uncovered holes in the movable support surface.

Because these holes are uncovered, the vacuum of the vacuum plenum induces air to flow through those uncovered holes. This airflow may deflect ink droplets and cause blurring of the image.

In some cases, holes along inboard and/or outboard edges that are parallel to the transport direction of the print media may also be uncovered, for example due to accommodating different sizes of print media. Similar blurring problems may also occur on these edges of the print media for similar reasons.

A need exists to improve the accuracy of the placement of droplets in inkjet printing systems and to reduce the appearance of blur of the final printed media product. A need further exists to address the blurring issues in a reliable manner and while maintaining speeds of printing and transport to provide efficient inkjet printing systems.

SUMMARY

Exemplary embodiments of the present disclosure may solve one or more of the above-mentioned problems and/or may demonstrate one or more of the above-mentioned desirable features. Other features and/or advantages may become apparent from the description that follows.

In accordance with at least one embodiment of the present disclosure a printing system comprises a print fluid deposition assembly, a media transport device, and an air flow control system. The print fluid deposition assembly comprises a carrier plate and a printhead supported by the carrier plate, wherein the printhead is arranged to eject a print fluid through an opening of the carrier plate and to a deposition region of the print fluid deposition assembly. The media transport device comprises a movable support surface, the media transport device configured to hold a print medium against the movable support surface by vacuum suction and the movable support surface configured to transport the print medium along a process direction through the deposition region of the print fluid deposition assembly. The air flow control system comprises an air supply unit arranged to flow air through the opening of the carrier plate between the carrier plate and the printhead. The air flow control system is configured to control the air supply unit to selectively flow the air based on a location of a print medium transported by the media transport device relative to the printhead. The air supply unit comprises an air guide structure comprising: an air outlet portion extending into the opening of the carrier plate between the printhead and the carrier plate, the air outlet portion terminating in an end wall that is angled obliquely relative to the movable support surface towards a reverse-process direction.

In accordance with at least one embodiment of the present disclosure a printing system comprises a print fluid deposition assembly, a media transport device, and an air flow control system. The print fluid deposition assembly comprises a carrier plate and a printhead supported by the carrier plate, wherein the printhead is arranged to eject a print fluid through an opening of the carrier plate and to a deposition region of the print fluid deposition assembly. The media transport device comprises a movable support surface, the media transport device configured to hold a print medium against the movable support surface by vacuum suction and the movable support surface configured to transport the print medium along a process direction through the deposition region of the print fluid deposition assembly. The air flow control system comprises an air supply unit arranged to flow air through the opening of the carrier plate between the carrier plate and the printhead. The air flow control system is configured to control the air supply unit to selectively flow the air based on a location of a print medium transported by the media transport device relative to the printhead. The air supply unit comprises an air guide structure attached to the printhead.

In accordance with at least one embodiment of the present disclosure, a method of operating a printing system comprises transporting a print medium through a deposition region of a print fluid deposition assembly of the printing system, wherein the print medium is held against a moving support surface via vacuum suction during the transporting. The method further comprises ejecting print fluid from a printhead of the printing assembly through an opening in a carrier plate supporting the printhead to deposit the print fluid to the print medium in the deposition region. The method also comprises controlling an airflow control system to selectively flow air through the opening in the carrier plate between the carrier plate and the printhead and to the movable support surface, wherein the controlling is based on a location of the print medium relative to the printhead. The selectively flowing the air through the opening comprises flowing the air through an air guide structure comprising an air outlet portion extending into the opening of the carrier plate between the printhead and the carrier plate and terminating in an end wall that is angled obliquely relative to the movable support surface toward a direction opposite a direction of the transporting.

BRIEF DESCRIPTION OF THE DRAWINGS

The present disclosure can be understood from the following detailed description, either alone or together with the accompanying drawings. The drawings are included to provide a further understanding of the present disclosure and are incorporated in and constitute a part of this specification. The drawings illustrate one or more embodiments of the present teachings and together with the description explain certain principles and operation. In the drawings.

DETAILED DESCRIPTION

Figure 1B:
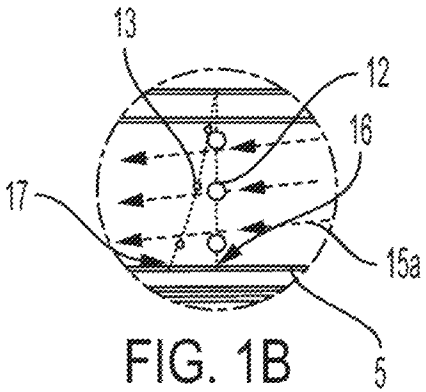
FIG. 1A-1I schematically illustrate airflow patterns relative to a printhead assembly, transport device, and print media during differing stages of print media transport through an ink deposition region of a conventional inkjet printing system, and resulting blur effects in the printed media product.
Figure 1C:
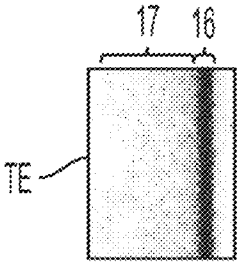
Figure 1A:
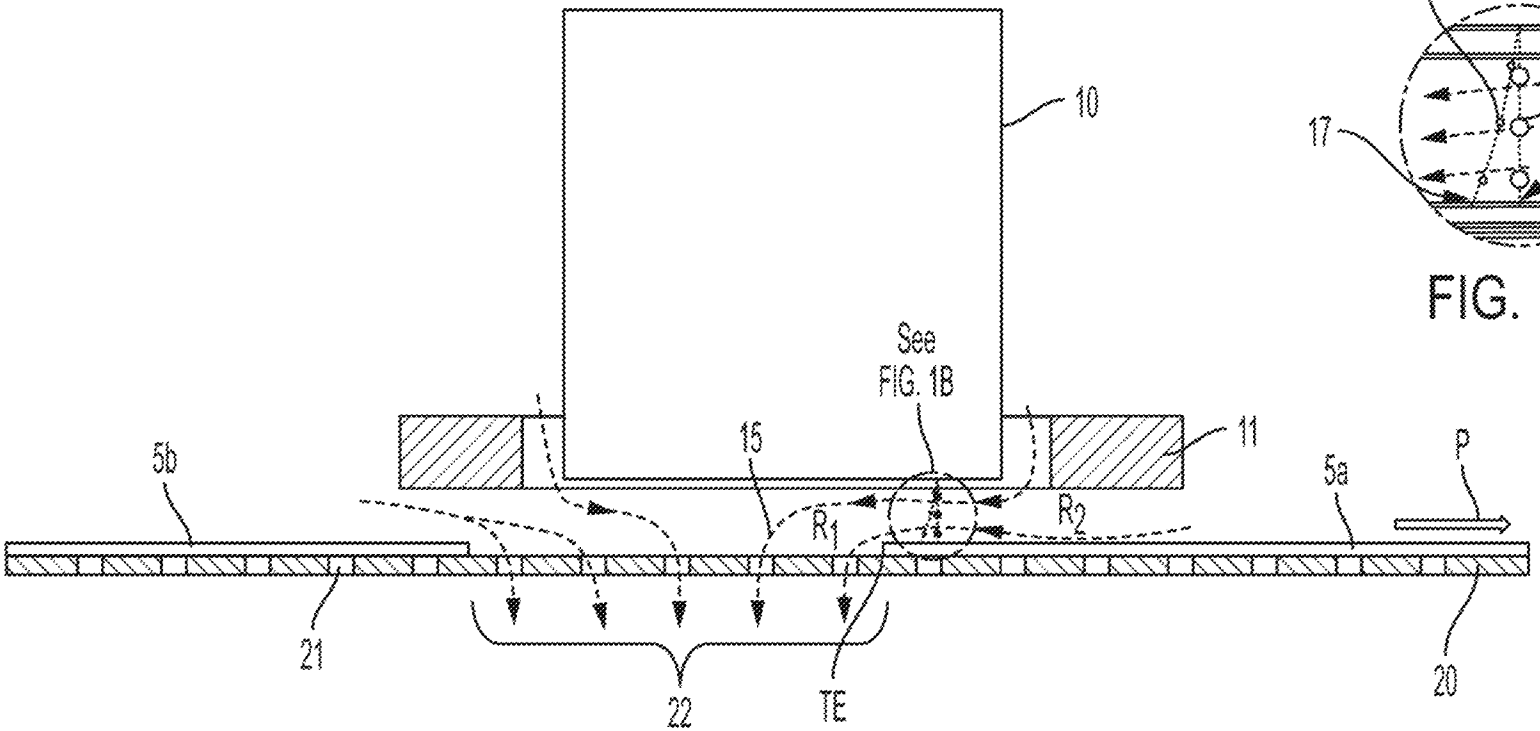
FIG. 1A RELATED ART
Figure 1D:
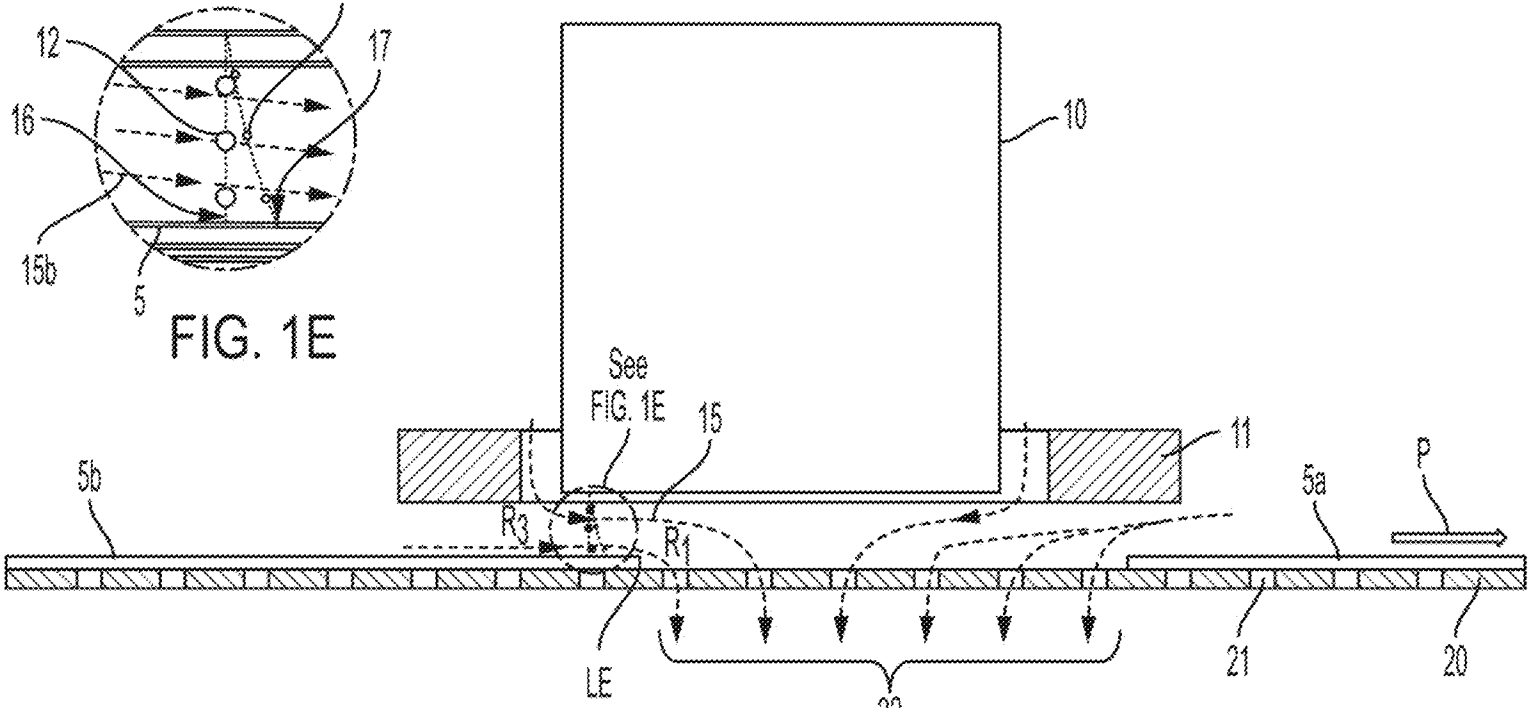
FIG. 1D RELATED ART
Figure 1E:
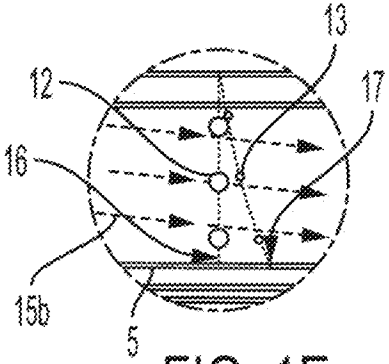
Figure 1F:
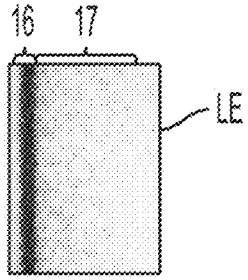
Figure 1H:
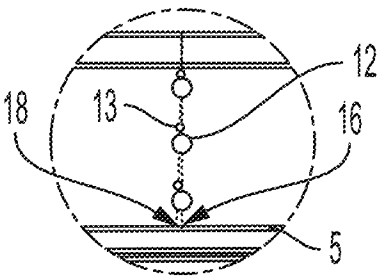
Figure 1G:
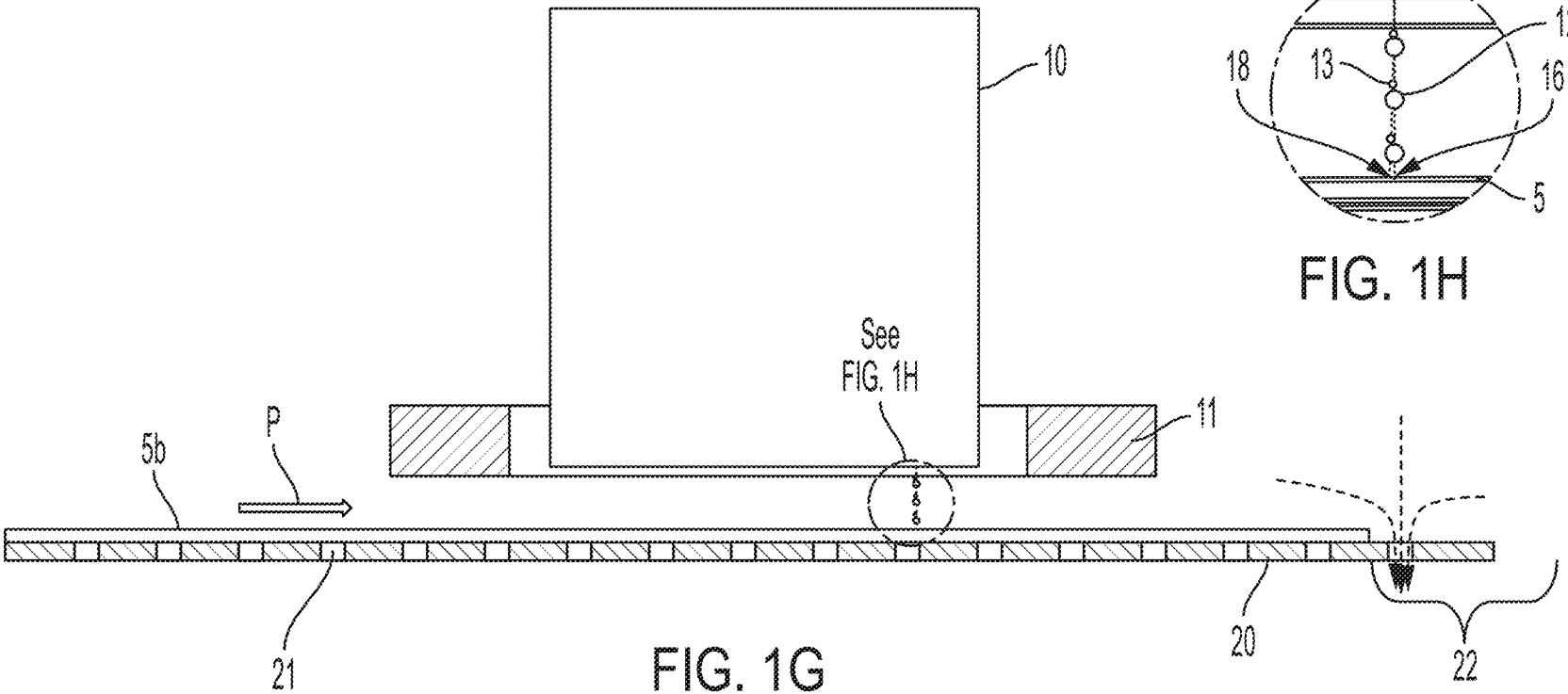
FIG. 1G RELATED ART
Figure 1I:
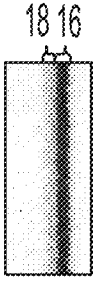

As described above, in inkjet printing systems utilizing vacuum to suction the print media to the transport device, various airflow patterns can occur that lead to undesirable displacement of droplets ejected from the printheads, thereby resulting in blurring of printed images on the print media. To better illustrate some of the phenomenon occurring giving rise to the blurring issues, reference is made to FIGS. 1A-1I. FIGS. 1A, 1D, and 1G illustrate schematically a printhead 10 printing on a print medium 5 near a trail edge TE, a lead edge LE, and a middle, respectively, of the print medium 5. FIGS. 1B, 1E, and 1H illustrate enlarged views of the regions A, B, and C, respectively. FIGS. 1C, 1F, and 1I illustrate enlarged pictures of printed images, the printed images comprising lines printed near the trail edge TE, lead edge LE, and middle, respectively, of a sheet of paper.

As shown in FIGS. 1A, 1D, and 1G, the inkjet printing system comprises a printhead 10 to eject ink to a print medium 5*a* near a trail edge TE of the print medium 5*a*, and a movable support surface 20 transports the print media 5 in a process direction P, which corresponds to a positive y-axis direction in the Figures. The movable support surface 20 slides along a top of a vacuum platen (not illustrated), and a vacuum environment is provided on a bottom side of the platen. The movable support surface 20 has holes 21 and the vacuum platen has platen holes, and the holes 21 and platen holes periodically align as the movable support surface 20 moves so as to expose the region above the movable support surface 20 to the vacuum below the platen. In regions where the print medium 5 covers the holes 21, the vacuum suction through the aligned holes 21 and 27 generates a force that holds the print medium 5 against the movable support surface 20. However, little or no air flows through these covered holes 21 and 27 since they are blocked by the print medium 5. On the other hand, as shown in FIGS. 1A and 1D, in the inter-media zone 22 the holes 21 and 27 are not covered by the print media 5, and therefore the vacuum suction pulls air to flow down through the holes 21 and 27 in the inter-media zone 22. This creates airflows, indicated by the dashed arrows in FIGS. 1A and 1D, which flow from regions around the printhead 10 towards the uncovered holes 21 and 27 in the inter-media zone 22, with some of the airflows passing under the printhead 10.

In FIG. 1A, the print medium 5*a* is being printed on near its trail edge TE, and therefore the region where ink is currently being ejected ("ink-ejection region") (e.g., region A in FIG. 1A) is located downstream of the inter-media zone 22 (upstream and downstream being defined with respect to the process direction P). Accordingly, some of the air being sucked towards the inter-media zone 22 will flow upstream through the ink-ejection region. More specifically, the vacuum suction from the inter-media zone 22 lowers the pressure in the region immediately above the inter-media zone 22, e.g., region $R_1$ in FIG. 1A, while the region downstream of the printhead 10, e.g., region $R_2$ in FIG. 1A, remains at a higher pressure. This pressure gradient causes air to flow in an upstream direction from the region $R_2$ to the region $R_1$, with the airflows crossing through the ink-ejection region (e.g., the circled region in FIG. 1A) which is between the regions $R_1$ and $R_2$. Airflows such as these, which cross through the ink-ejection region, are referred to herein as crossflows 15. In FIG. 1A, the crossflows 15 flow upstream, but in other situations the crossflows 15 may flow in different directions.

As shown in the enlarged view in FIG. 1B, which comprises an enlarged view of the circled region in FIG. 1A, as ink is ejected from the printhead 10 towards the medium 5, main drops 12 and satellite drops 13 are formed. The satellite drops 13 are much smaller than the main drops 12 and have less mass and momentum, and thus the upstream crossflows 15*a* tend to affect the satellite drops 13 more than the main drops 12. Thus, while the main drops 12 may land on the print medium 5 near their intended deposition location 16 regardless of the crossflows 15, the crossflows 15 may push the satellite drops 13 away from the intended trajectory so that they land at an unintended location 17 on the medium 5, the unintended location 17 being displaced from the intended location 16. This can be seen in the actual printed image in FIG. 1C, in which the denser/darker line-shaped portion is formed by the main drops 12 which were deposited predominantly at their intended locations 16, whereas the smaller dots dispersed away from the line are formed by satellite drops 13 which were blown away from the intended locations 16 to land in unintended locations 17, resulting in a blurred or smudged appearance for the printed line. Notably, the blurring in FIG. 1C is asymmetrically biased towards the trail edge TE, due to the crossflows 15 near the trail edge TE blowing primarily in an upstream direction. The inter-media zone 22 may also induce other airflows flowing in other directions, such as downstream airflows from an upstream side of the printhead 10, but these other airflows do not pass through the region where ink is currently being ejected in the illustrated scenario and thus do not contribute to image blur. Only those airflows that cross through the ink ejection region are referred to herein as crossflows.

FIGS. 1D-1F illustrate another example of such blurring occurring, but this time near the lead edge LE of the print medium 5*b*. The cause of blurring near the lead edge LE as shown in FIGS. 1D and 1F is similar to that described above in relation to the trail edge TE, except that in the case of printing near the lead edge LE the ink-ejection region is now located upstream of the inter-media zone 22. As a result, the crossflows 15 that are crossing through the ink-ejection region now originate from the upstream side of the printhead 10, e.g., from region $R_3$, and flow downstream. Thus, as shown in the enlarged view of FIG. 1E, which comprises an enlarged view of the circled region in FIG. 1D, in the case of printing near the lead edge LE, the satellite drops 13 are blown downstream towards the lead edge LE of the print medium 5*b* (positive y-axis direction). As shown in FIG. 1F, this results in asymmetric blurring that is biased towards the lead edge LE.

In contrast, as shown in FIG. 1G and the enlarged view in FIG. 1H, which corresponds to an enlarged view of circled region in FIG. 1, farther from the edges of the print media 105 there may be little or no crossflows 15 because the inter-media zone 22 is too distant to induce much airflow. Because the crossflows 15 are absent or weak farther away from the edges of the print medium 5, the satellite drops 13 in this region are not as likely to be blown off course. Thus, as shown in FIGS. 1H and 1I, when printing farther from the edges of the print medium 5*b*, the satellite drops land at locations 18 that are much closer to the intended locations 16 resulting in much less image blurring. The deposition locations 18 of the satellite drops may still vary somewhat from the intended locations 16, due to other factors affecting the satellite drops 13, but the deviation is smaller than it would be near the lead or trail edges.

As described above, when an inter-media zone is near or under a printhead, the uncovered holes in the inter-media zone can create crossflows that can blow satellite droplets off course and cause image blur (see FIGS. 1A-D). Example technologies disclosed herein may, among other things, reduce or eliminate such image blur by utilizing an airflow control system that reduces or eliminates the crossflows. With the crossflows reduced or eliminated, the satellite droplets are more likely to land nearer their intended deposition locations, and therefore the amount of blur is reduced.

Figure 2:
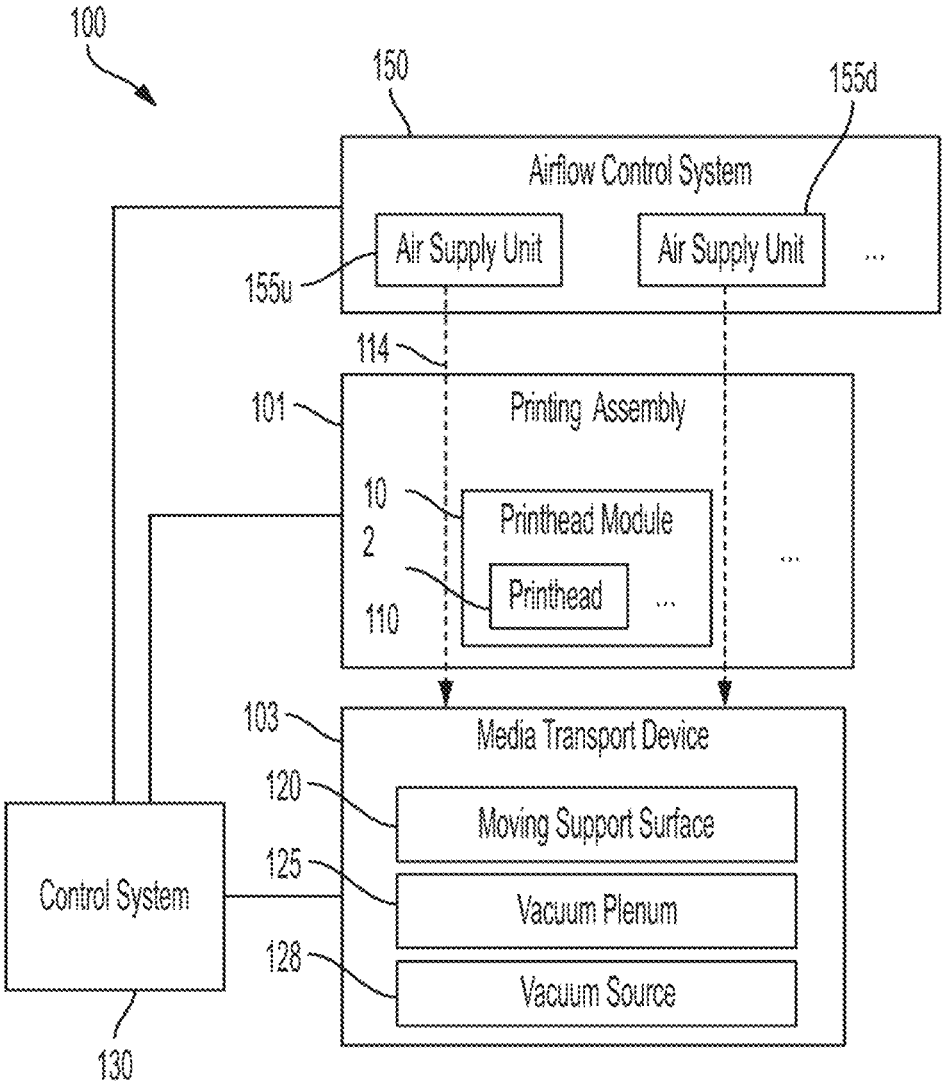
FIG. 2 is a block diagram illustrating components of an embodiment of an inkjet printing system including an airflow control system.

FIG. 2 is a block diagram schematically illustrating an embodiment of printing system 100 that utilizes such an airflow control system. FIG. 3 also illustrates aspects of the printing system 100. As shown in FIG. 2, the printing system 100 comprises an ink deposition assembly 101, a media transport device 103, an airflow control system 150, and a control system 130. The ink deposition assembly 101 (also referred to herein as a "print fluid deposition assembly") is configured to eject a print fluid, such as ink, onto print media passing through an ink deposition region of the ink deposition assembly 101. The media transport device 103 is configured to transport the print media through the ink deposition region. The airflow control system 150 is configured to provide make-up air 155 as described the above. The control system 130 comprises processing circuitry to control operations of the printing system 100.

The ink deposition assembly 101 comprises one or more printhead modules 102. One printhead module 102 is illustrated in FIG. 2 for simplicity, but any number of printhead modules 102 may be included in the ink deposition assembly 101. In some examples, each printhead module 102 may correspond to a specific ink color, such as cyan, magenta, yellow, and black. Each printhead module 102 comprises one or more printheads 110 configured to eject the ink onto the print media to form an image. One printhead 110 is illustrated in FIG. 2 for simplicity, but any number of printheads 110 may be included per printhead module 102. The printhead modules 102 may also include additional structures and devices to support and facilitate operation of the printheads 110, such as carrier plates (e.g., carrier plates 511, 711, 1011, 1111 described further below), ink supply lines, ink reservoirs, electrical connections, and so on.

The media transport device 103 comprises a movable support surface 120, a vacuum plenum 125, and a vacuum source 128. The movable support surface 120 is to transport the print media through a deposition region of the ink deposition assembly 101. The vacuum plenum 125 may supply vacuum suction to one side of the movable support surface 120 (e.g., a bottom side), and print media may be supported on an opposite side of the movable support surface 120 (e.g., a top side). As shown in FIGS. 3A-3E, holes 121 through the movable support surface 120 communicate the vacuum suction through the surface 120, such that the vacuum suction acts to hold down the print media 105 against the surface 120. The movable support surface 120 may be movable relative to the ink deposition assembly 101, and thus the print media held against the movable support surface 120 is transported relative to the ink deposition assembly 101 as the movable support surface 120 moves. The movable support surface 120 can comprise any structure that can be driven to move relative to the ink deposition assembly 101 and which has holes 121 to allow the vacuum suction to hold down the print media, such as a belt, a drum, etc. The vacuum plenum 125 may comprise baffles, walls, or any other structures arranged to enclose or define an environment in which a vacuum state (e.g., low pressure state) is maintained by the vacuum source 128, with the plenum 125 fluidically coupling the vacuum source 128 to the movable support surface 120. The vacuum plenum 125 may include one or more holes or openings near the movable support surface 120 that expose the movable support surface 120 to the vacuum within the vacuum plenum 125. For example, in some embodiments a top surface of the vacuum plenum 125 is a vacuum platen having a number of holes which communicate the vacuum suction to the underside of the movable support surface 120. As another example, in some embodiments the movable support surface 120 is itself part of the vacuum platen 126, which comprises a rotating drum, as described in further detail below. The vacuum source 128 may be any device configured to remove air from the plenum 125, such as a fan, a pump, etc.

The airflow control system 150 comprises two or more air supply units 155. The air supply units 155 are configured to supply make-up air 114 to the movable support surface 120 at timings based on the locations of the lead edge LE and trail edge TE of print media so as to reduce or eliminate cross-flow air patterns tending to cause leading edge or trailing edge blur. The airflow control system 150 may reduce or eliminate the crossflows by providing makeup air 114 to the inter-media zone 122 at strategic timings to neutralize the pressure gradients that would otherwise cause the crossflows.

The air supply units 155 are arranged in pairs, with each pair corresponding to one of the printhead modules 102 or one of the individual printheads 110. As illustrated in FIGS. 2 and 3A-3E, one of the air supply units 155 of each pair is arranged adjacent to and upstream of its corresponding printhead module 102 or printhead 110, and may be referred to as an upstream air supply unit 155*u* in relation to that printhead module 102 or printhead 110. The other one of the air supply units 155 in each pair is arranged adjacent to and downstream of its corresponding printhead module 102 or printhead 110, and may be referred to as a downstream air supply unit 155*d* in relation to that printhead module 102 or printhead 110. In some embodiments, the same air supply unit 155 may serve as the upstream supply unit 155*u* for one pair and also as the downstream air supply unit 155*d* of another pair. As shown in FIGS. 3A-3E, each air supply unit 155 comprises an air guide structure 156 coupled to an air source 157 (e.g., controllable valve, fan, pump, etc.) which is controlled to selectively provide the makeup air 114 at the desired timings. The guide structures 156 can include, but are not limited to, for example, any of baffles, nozzles, air knives, vents, ducts, or combinations thereof to direct and/or alter the pressure or flow rate of the make-up airflow as desired.

The timings and locations of supplying the makeup air 114 correspond generally to the timings when the inter-media zone 122 is near (e.g., passing under) the printhead 110, for example when the inter-media zone 122 is located in a deposition region under the printheads 110. In other words, the makeup air 114 is supplied while portions of the print media 105 that are near a trail edge TE are being printed and while portions of the print media 105 that are near the lead edge LE are being printed. The timings and effects of supplying makeup air 114 from air supply units 155 will be described below with reference to FIGS. 3A-3E.

FIGS. 3A-3E illustrate a sequence of events involving print media 105 passing through a deposition region of a given printhead 110 or printhead module 102 of the printer 100, including the supplying of makeup air 114 from a given pair of air supply units 155*u* and 155*d* that correspond to the given printhead 110 or printhead module 102. As noted above, the printing system 100 may include multiple printheads 110 and/or multiple printhead modules 102, but FIGS. 3A-3E illustrates the operations associated with just one printhead 110/printhead module 102 to simplify the description. In systems in which additional printheads 110 or printhead modules 102 are included, the timings for supplying makeup air 114 from air supply units 155 associated with the additional printheads 110/printhead modules 102 would be similar to those described in relation to FIGS. 3A-3E, except that the various locations and timings would be relative to the additional printhead 110 and/or printhead module 102.

Figure 3A:
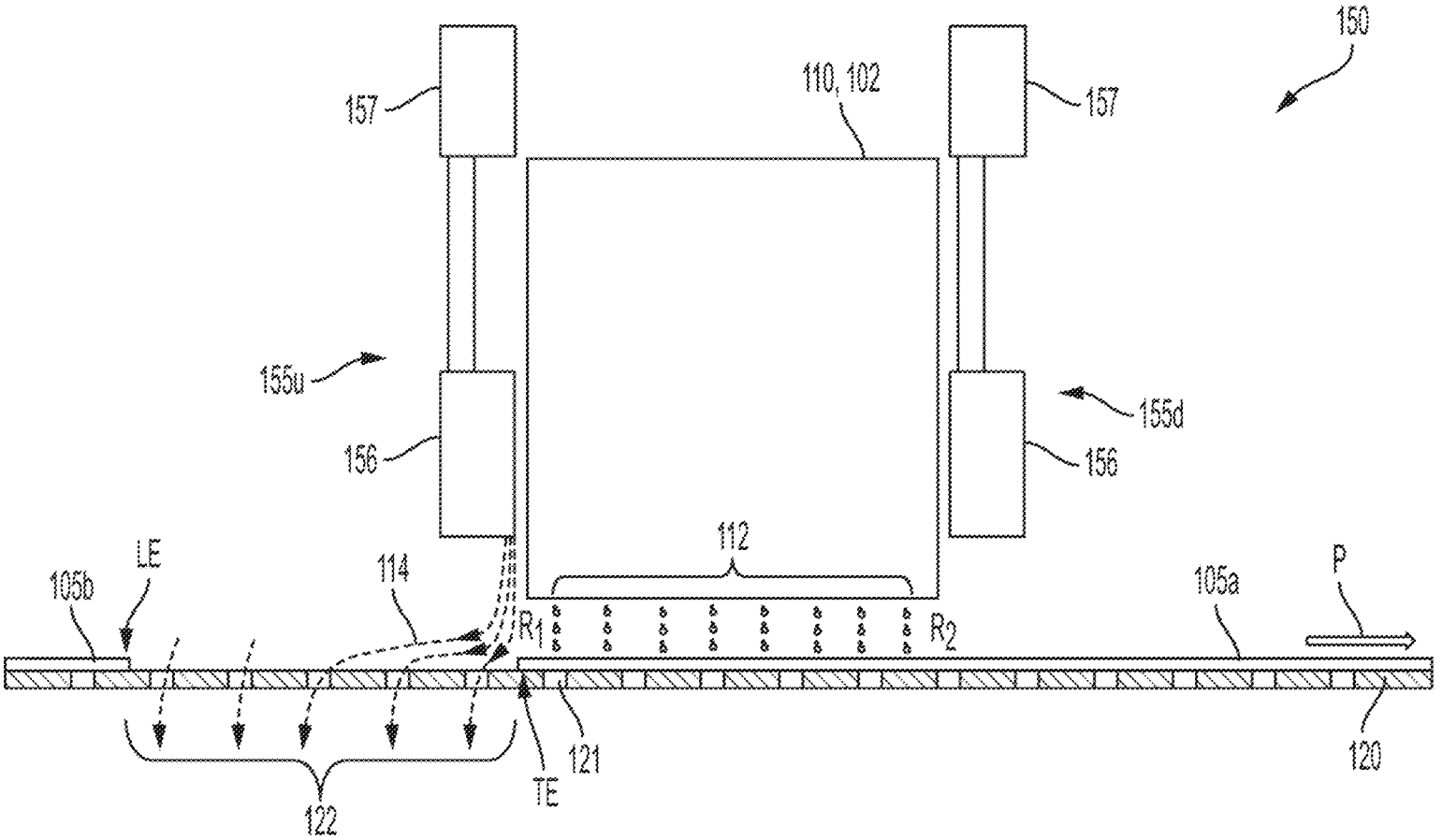
FIGS. 3A-3E are schematic illustrations of components of an embodiment of an inkjet printing system including an airflow control system with various states of the airflow control system in use depicted.
Figure 3B:
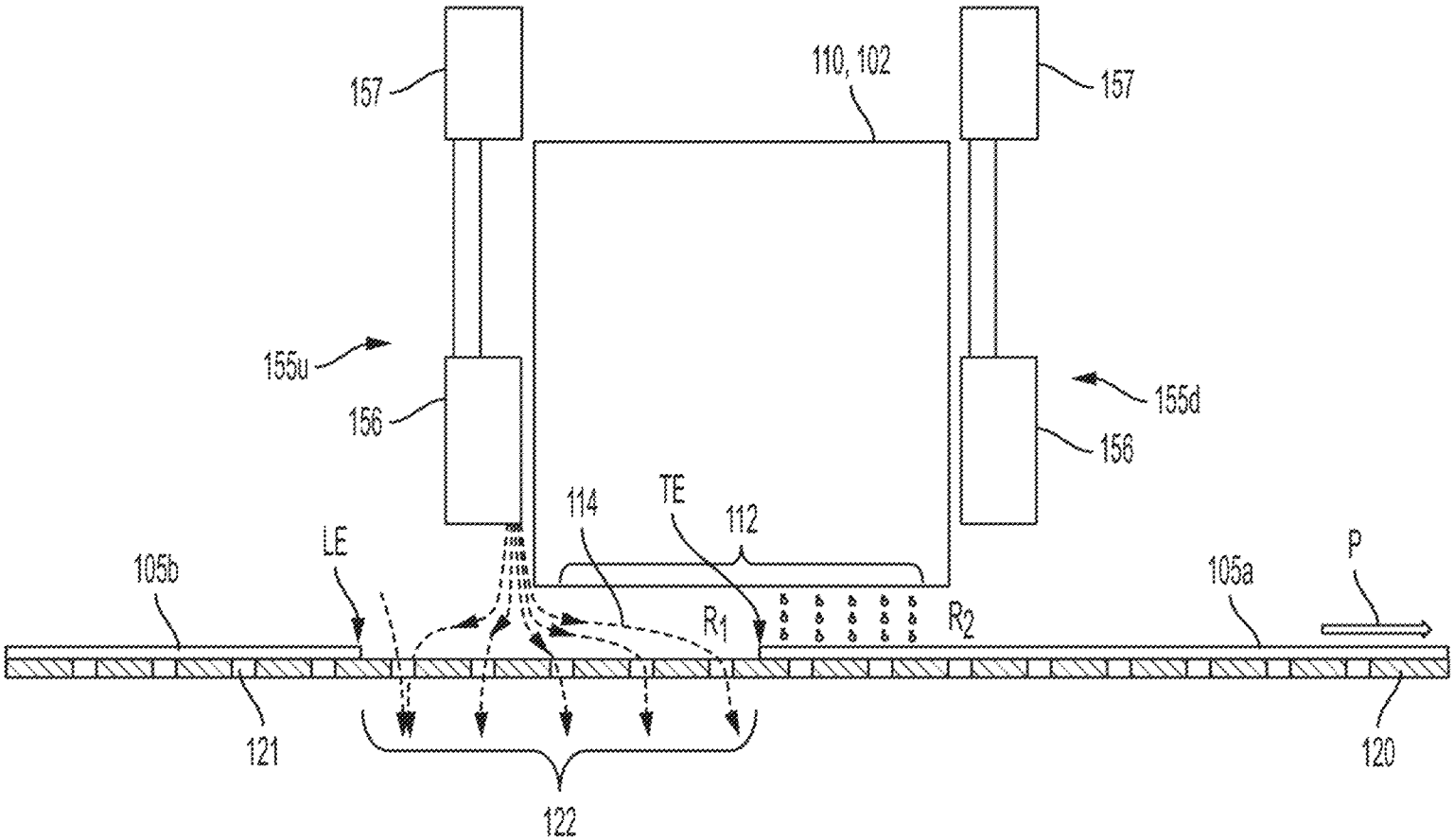

For example, as illustrated in FIGS. 3A and 3B, as the trail edge TE of the print medium 105*a*, and consequently the inter-media zone 122, enters into and travels through the deposition region under the printhead 110, the air supply unit 155*u* that is upstream of the printhead 110/printhead module 102 may supply makeup air 114 while the air supply unit 155*d* does not supply makeup air. The positive makeup air 114 supplied from the upstream air supply unit 155*u* increases the pressure in the region $R_1$ between the printhead 110/printhead module 102 and the inter-media zone 122, and thus reduces or eliminates the pressure gradient that would otherwise exist between the region $R_1$, where the uncovered holes 121 of the movable support surface 120 corresponding to the inter-media zone 122 are, and the region $R_2$ immediately downstream of the printhead 110/printhead module 102. Accordingly, air from the downstream side of the printhead 110/printhead module 102 is no longer pulled (or is pulled less strongly) upstream under the printhead 110/printhead module 102 toward the inter-media zone 122, and thus the upstream crossflows 15 illustrated in FIG. 1A are reduced or eliminated. Once the trail edge TE of the print media 105 has advanced to an end of the deposition region of the printhead 110/printhead module 102, the airflow control system can be controlled such that upstream air supply unit 155*u* ceases to supply makeup air 114, as the issues associated with the trail edge blurred are no longer problematic for the print medium 105*a* past this point.

Figure 3C:
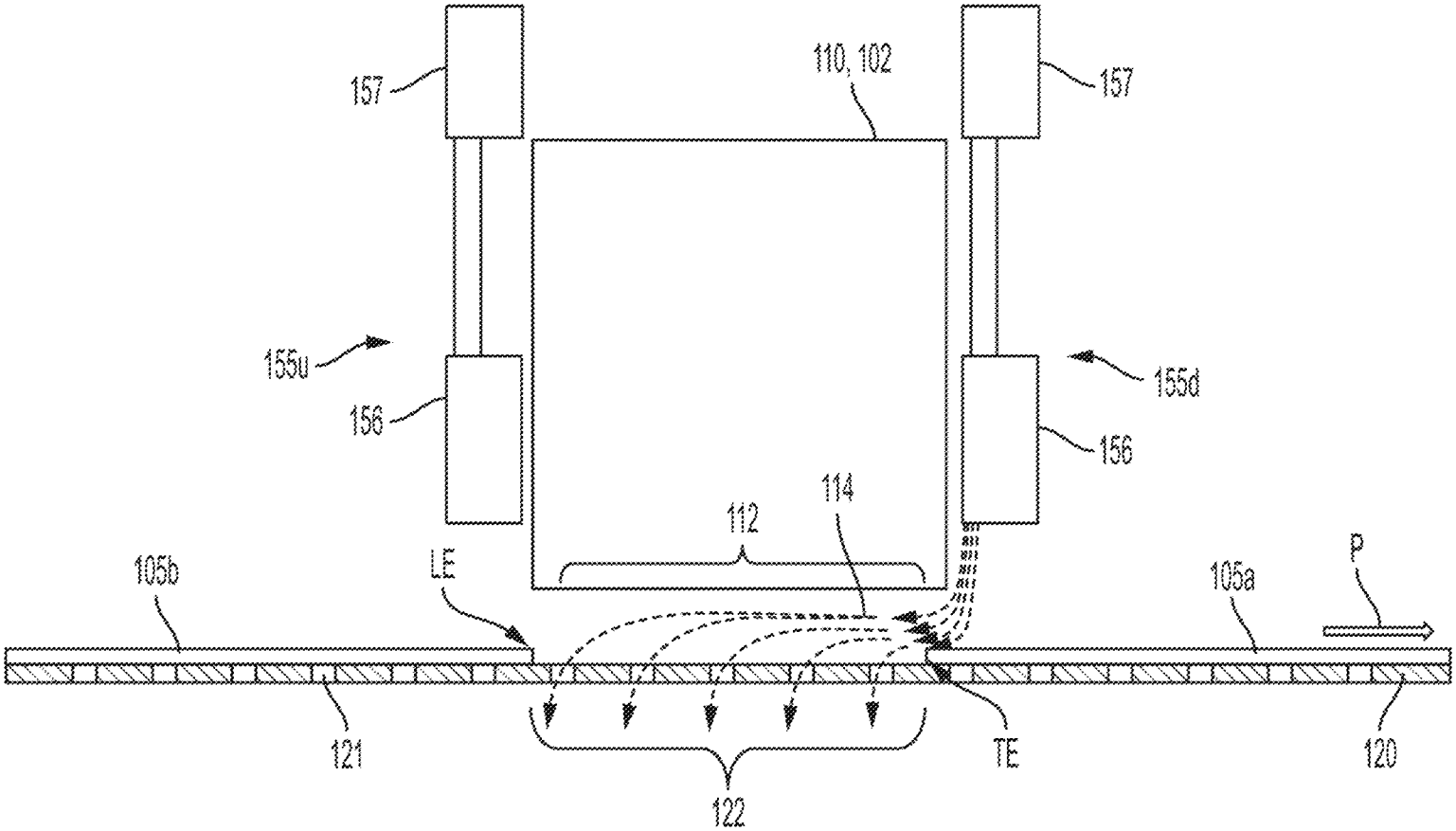
Figure 3D:
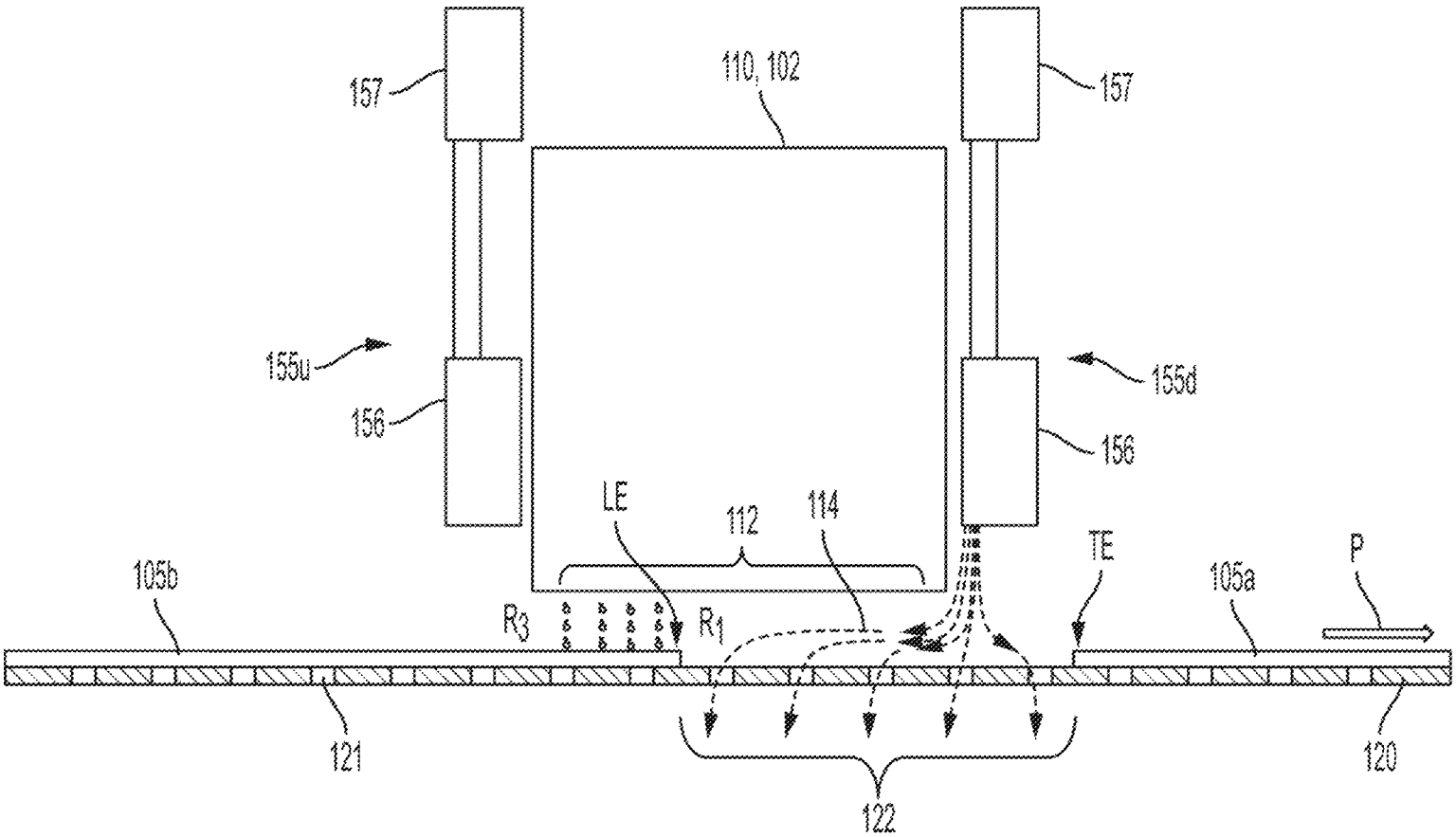
Figure 3E:
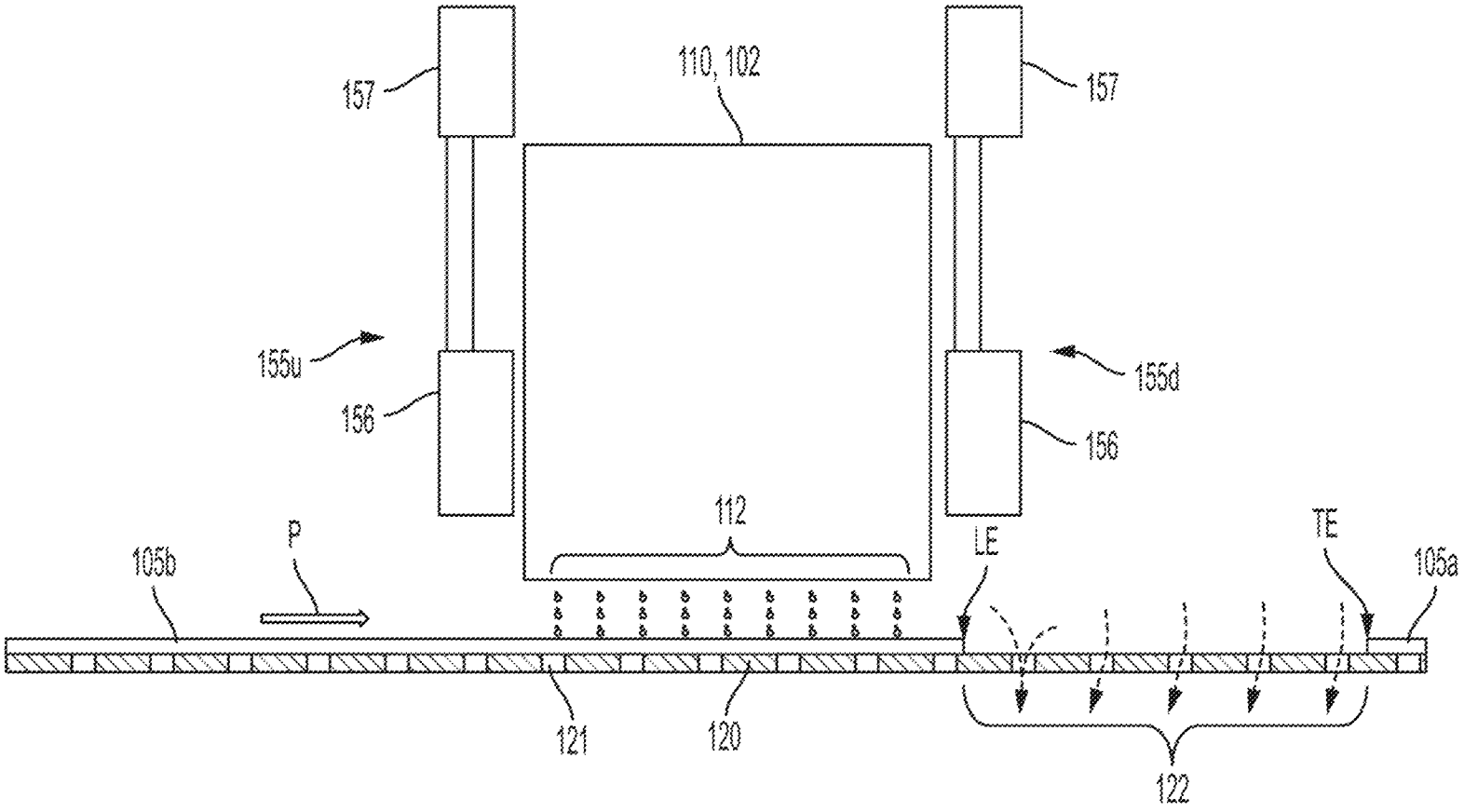

Conversely, as illustrated in FIGS. 3C and 3D, when the lead edge LE of a print medium 105, such as the subsequent print medium 105*b* that is being printed in a print job, is entering into and passing through the deposition region under the printhead 110/printhead module 102, the airflow control system can control the air supply unit 155*d* that is downstream of the printhead 110/printhead module 102 to supply makeup air 114 while the air supply unit 155*u* does not supply makeup air. The positive makeup air 114 supplied from the downstream air supply unit 155*d* increases the pressure in the region $R_1$ above the inter-media zone 122 with the uncovered holes 121, and thus reduces or eliminates the pressure gradient that would otherwise exist between the region $R_1$ and a region $R_3$ immediately upstream of the printhead 110/printhead module 102. Accordingly, air from the region $R_3$ upstream of the printhead 110/printhead module 102 is no longer pulled (or is pulled less strongly) downstream under the printhead 110/printhead module 102 toward the inter-media zone 122, and thus the downstream crossflows 15 illustrated in FIG. 1C are reduced or eliminated. Once the leading edge LE has advanced to an end of the deposition region under the printhead 110/printhead module 102, the risk of lead edge image blur is reduced because the uncovered holes 121 of the support surface 120 are relatively distant from the deposition region and thus are less likely to draw air through the deposition region. Accordingly, as depicted in FIG. 3E, the air control system can cease the supply of makeup air from the downstream air supply unit 155*d*, with the upstream air supply unit 155*u* also not supplying makeup air, when the lead edge LE is at or beyond this point.

Thus, the upstream air supply unit 155*u* and the downstream air supply unit 155*d* may alternate when they supply makeup air 114, with the supply of makeup air 114 being timed (at least in part) based on the location of the lead edges LE and/or trail edges TE of the print media 105 relative to the printhead 110/printhead module 102, or in other words based on the position of the inter-media zone 122 relative to the printhead 110/printhead module 102. The airflow control system of FIGS. 2A-2E can thus supply makeup air 114 in a manner that reduces or eliminates the crossflows 15 induced by the uncovered air-holes 121 in the inter-media zone 122, thus addressing the issues of blur caused by such crossflows 15 carrying satellite ink droplets to undesired locations on the print media.

One possible concern with supplying the makeup air 114 is that the makeup air 114 itself could create or contribute to crossflows that cause image blur. However, by controlling the timings and amounts at which the makeup air 114 is supplied, the risk of the makeup air 114 causing crossflows through the region where the ink is being ejected can be reduced.

For example, as illustrated in FIG. 3A, the supply of makeup air 114 from the upstream air supply unit 155*u* may begin when the inter-media zone 122 approaches the upstream side of the printhead 110/printhead module 102, i.e., when the inter-media zone 122 reaches a first position relative to the printhead 110/printhead module 102. In other words, the supply of makeup air 114 may begin when the trail edge TE of the print medium 105*a* approaches the upstream side of the printhead 110/printhead module 102 and is entering or about to enter the deposition region. More specifically, in some embodiments, the supply of makeup air 114 from the upstream air supply unit 155*u* may begin when the inter-media zone 122 reaches a first position in which the trail edge TE of the downstream print medium 105*a* is near or aligned with one of the following features: the upstream edge of a carrier plate of a printhead module 102 (not illustrated in FIGS. 2-3E, but see the carrier plates 511, 711, 1011, and 1111 as examples), the upstream edge of an opening in the carrier plate (not illustrated in FIGS. 2-3E, but see the openings 519, 710, 1019, and 1119 as examples), an air outlet in the upstream air supply unit 155*u* (not illustrated in FIGS. 2-3E, but see the air outlets 558, 758, 858, 1065, and 1158 as examples), the upstream edge of the printhead 110, and the upstream edge of an ink ejection zone 112 of the printhead 110 or printhead module 102 (the ink ejection zone 112 corresponding to a region from which ink is ejected, such as a region containing ink ejection nozzles).

Furthermore, as illustrated in FIG. 3C, the supply of makeup air 114 from the upstream air supply unit 155*u* may cease when the inter-media zone 122 reaches a second position relative to the printhead 110 in which the trail edge TE of the print medium 105*an* is at, is approaching, or has passed a point on the downstream side of the printhead 110 and/or when the LE of the next print medium 105*b* is at, is approaching, or has passed a point on the upstream side of the printhead 110. More specifically, in some embodiments, second position of the inter-media zone 122 at which the supply of makeup air 114 from the upstream air supply unit 155*u* ceases corresponds to the trail edge TE of print medium 105, such as the first medium 105*a*, being near or aligned with one of the following features: the downstream edge of a carrier plate, the downstream edge of an opening in the carrier plate, an air outlet in the downstream air supply unit 155*d*, the downstream edge of the printhead 110, and the downstream edge of an ink ejection zone 112 of the printhead 110 or printhead module 102. In some embodiments, second position of the inter-media zone 122 at which the supply of makeup air 114 from the upstream air supply unit 155*u* ceases corresponds to the LE of a print medium 105, such as the subsequent print medium 105*b*, being near or aligned with one of the following features: the upstream edge of a carrier plate, the upstream edge of an opening in the carrier plate, an air outlet in the upstream air supply unit 155*u*, the upstream edge of the printhead 110, and the upstream edge of an ink ejection zone 112 of the printhead 110.

As illustrated in FIG. 3C, the supply of makeup air 114 from the downstream air supply unit 155*d* may begin when the inter-media zone 122 reaches a third position relative to the printhead 110/printhead module 102 in which the trail edge TE of the print medium 105*a* is at, is approaching, or has passed a point on the downstream side of the printhead 110/printhead module 102 and/or when the LE of the next print medium 105*b* is at, is approaching, or has passed a point on the upstream side of the printhead 110. In other words, the supply of makeup air 114 from the downstream unit 155*d* may begin when the lead edge LE of the next print medium 105*b* to be printed on approaches an upstream side of the printhead 110, and/or when the trail edge TE of print medium 105, such as the preceding print medium 105*a*, approaches a downstream side of the printhead 110. More specifically, in some embodiments, the third position of the inter-media zone 122 at which the supply of makeup air 114 from the downstream air supply unit 155*u* begins corresponds to the lead edge LE of a print medium 105, such as the next print medium 105*b*, being near or aligned with one of the following features: the upstream edge of a carrier plate, the upstream edge of an opening in a carrier plate, an air outlet in the upstream air supply unit 155*u*, the upstream edge of the printhead 110, and the upstream edge of an ink ejection zone 112 of the printhead 110/printhead module 102. In some examples, the third position of the inter-media zone 122 at which the supply of makeup air 114 from the downstream air supply unit 155*u* begins corresponds to the trail edge TE of the prior print medium 105*a* being near or aligned with one of the following features: the downstream edge of a carrier plate, the downstream edge of an opening in the carrier plate, an air outlet in the downstream air supply unit 155*u*, the downstream edge of the printhead 110, and the downstream edge of an ink ejection zone 112 of the printhead 110. In some embodiments, including that of FIG. 3C, the second and third positions of the inter-media zone 122 are the same, and thus the timing when the downstream air supply unit 155*d* starts supplying makeup air 114 may coincide with the timing when the upstream air supply unit 155*u* ceases supplying makeup air 114.

As illustrated in FIG. 3E, the supply of makeup air 114 from the downstream air supply unit 155*d* may cease when the inter-media zone 122 reaches a fourth position relative to the printhead 110/printhead module 102, e.g., a position in which the inter-media zone 122 is downstream of the printhead 110/printhead module 102. In other words, the supply of makeup air 114 from the downstream unit 155*d* may cease when the lead edge LE of the print medium 105*b* approaches the downstream side of the printhead 110/printhead module 102. More specifically, in some examples, the supply of makeup air 114 from the downstream air supply unit 155*d* may cease when the inter-media zone 122 reaches a fourth position in which the lead edge LE of the print medium 105*b* is near or aligned with one of the following features: the downstream edge of a carrier plate, the downstream edge of an opening in the carrier plate, an air outlet in the downstream air supply unit 155*u*, the downstream edge of the printhead 110, and the downstream edge of an ink ejection zone 112 of the printhead 110/printhead module 102. As also illustrated in FIG. 2E, the upstream air supply unit 155*u* continues to also be controlled to not supply any makeup air during this state of operation.

In various embodiments, as those having ordinary skill in the art would appreciate, the airflow control system 150 generally controls the upstream air supply unit 155*u* to not be supplying makeup air during the operational state in which the downstream air supply unit 155*d* is supplying makeup air and vice versa. However, in other embodiments, the upstream air supply unit 155*u* and the downstream air supply unit 155*d* may occasionally supply makeup air at the same time. For example, in some embodiments, when the inter-media zone 122 is relatively wide, the trail edge TE of the print medium 105*a* reaches the third position before the lead edge LE of the subsequent print medium 105*b* reaches the second position, in which case the upstream air supply unit 155*u* and the downstream air supply unit 155*d* may both supply makeup air during the time period between the timing when the trail edge TE reaches the third position and the timing when the lead edge LE reaches the second position.

Thus, throughout the period during which makeup air 114 is supplied (see FIGS. 3A-3E), the inter-media zone 122 is located near the air supply unit 155*u* or 155*d* that is supplying the makeup air 114, and therefore most or all of the supplied makeup air 114 tends to get sucked into the inter-media zone 122. Further, the rate and/or direction at which makeup air 114 is supplied can be controlled by the airflow control system such that nearly all of the makeup air 114 ends up getting sucked down into inter-media zone 122, with very little or none of the makeup air 114 being left over to flow to other locations so as to create undesirable flow patterns. Moreover, the side of the printhead 110 from which the makeup air 114 is supplied is controlled such that the makeup air 114 that gets sucked from the air supply unit 114 into the inter-media zone 122 does not pass through the portion of the deposition region in which ink droplets are being ejected from the printhead 110. In other words, the region in which ink is being ejected is never located between the inter-media zone 122 and the air supply unit 155 that is currently supplying makeup air 114. Thus, most or all of the makeup air 114 gets sucked into the inter-media zone 122 without passing through the region where ink is being deposited, and therefore the makeup air 114 does not create significant blur-inducing crossflows.

In the discussion above, specific examples for the timings and locations for when makeup air 114 is supplied are described. However, the precise locations of the lead edge LE and the trail edge TE with respect to the printhead 110/printhead module 102 which are used to trigger the supply of makeup air 114 and the ceasing of supply of makeup air 114 may vary from system to system or even from time to time within the same system. The airflow control systems disclosed herein, including the airflow control system 150, are not limited to any specific set of timings/trigger locations. Any desired timings/trigger locations for supplying or ceasing the makeup air may be used as long as the supply of makeup air is selectively turned on and off based on the location of the inter-media zone 122 (lead edge LE and trail edge TE). In some cases, the specific timings that are used may be programed into a control system that controls operations of the airflow control system 150 (e.g., control system 130, described below). In some examples, timings that produce adequate blur reduction may be determined experimentally by iteratively printing test images, determining an amount of image blur, adjusting the timings based on the blur, and repeating the process until acceptable results are obtained. In some cases, the timings may be determined and adjusted automatically and dynamically by the printing system based on feedback obtained during actual usage. For example, the printing system may automatically scan the images it prints, detect an amount of image blur in the printed image, adjust the timings for starting/stopping supply of the makeup air 114 based on the amount of blur that is detected, and repeat this process for successive printed images until timings which produce acceptable amounts of image blur are converged upon.

Referring again to FIG. 2, the control system 130 comprises processing circuitry to control operations of the printing system. The processing circuitry may include one or more electronic circuits configured with logic for performing the various operations. The logic of the processing circuitry may comprise dedicated hardware to perform various operations, software instructions to perform various operations, or any combination thereof. In examples in which the logic comprises software instructions, the processing circuitry may include a processor to execute the software and a memory device that stores the software. The processor may comprise one or more processing devices capable of executing machine readable instructions, such as, for example, a processor, a processor core, a central processing unit (CPU), a controller, a microcontroller, a system-on-chip (SoC), a digital signal processor (DSP), a graphics processing unit (GPU), etc. In examples in which the processing circuitry includes dedicated hardware, in addition to or in lieu of the processor, the dedicated hardware may include any electronic device that is configured to perform specific operations, such as an Application Specific Integrated Circuit (ASIC), a Field Programmable Gate Array (FPGA), a Complex Programmable Logic Device (CPLD), discrete logic circuits, a hardware accelerator, a hardware encoder, etc. The processing circuitry may also include any combination of dedicated hardware and processor plus software.

Although the various components of the printing system 100 are illustrated and described separately for ease of understanding, it should be understood that in practice these components are not necessarily physically or logically distinct. For example, in some embodiments the air supply units 155 may be located within the printhead modules 102, and thus the air supply units 155 could be considered as being part of the ink deposition assembly 101 from that perspective. As another example, the supply of makeup air 114 by the air supply units 155 may be controlled, in whole or in part, by components of the control system 130, and therefore those component of the control system 130 may be considered as also being parts of the airflow control system 150 from that perspective.

As noted above, the timings at which makeup air 114 is supplied may be based on the position of the inter-media zones 122 between printed media 105 (i.e., locations of the lead edge LE and trail edge TE of the print media 105), or to put the same point differently, based on the location of the inter-media zone 122. Thus, embodiments disclosed herein may utilize a location tracking system to track the location of the print media 105 as they are transported through the ink deposition assembly, and a controller of the printer may determine locations of the lead edge LE and trail edge TE of a print medium 105 based on tracked location information. As used herein, tracking the location of the print media 105 refers to the system having knowledge, whether direct or inferred, of where the print media is located at various points as it is transported through the ink deposition assembly. Direct knowledge of the location of the print media 105 may comprise information obtained by directly observing the print media, for example via a sensor (e.g., an edge detection sensor). Inferred knowledge of the location of the print media 105 may be obtained by inference from other known information, for example by calculating how far the print media 105 would have moved from a previously known location based on a known speed of the movable support surface. In some examples disclosed herein, the location tracking system may explicitly track a location of the lead edge LE and/or the trail edge TE. However, in other embodiments disclosed herein, the location tracking system may explicitly track the location of some other part of the print medium, in which case the locations of the lead edge LE and/or the trail edge TE may be inferred based on known dimensions of the print medium.

Most existing printing systems are already configured with print registration mechanisms to track the locations of the print media as they are transported through the ink deposition assembly, as knowledge of the locations of the print media may be helpful to ensure accurate image formation on the print media. Thus, various systems for tracking the location of print media are well known in the art. Because such location tracking systems are well known, they will not be described in detail herein. Any known location tracking system (or any new location tracking system) may be used in the embodiments disclosed herein to track the location of print media, and a controller may use this information to determine the locations of the lead edge LE and/or the trail edge TE (if not already known).

As noted above, it may be helpful in some circumstances for the flow rate of the makeup air 114 to be matched to the rate at which air is sucked into the inter-media zone. This flow rate may be determined experimentally, for example by printing test images with different flow rates for the makeup air and identifying the flow rate that produces the best results. Alternatively, the desired flow rate may be estimated by calculating an estimated rate of suction through the inter-media zone based on known dimensions of the inter-media zone and its air-holes and based on known characteristics of the vacuum source. In some examples, the size of the inter-media zone may vary depending on the size of the print media selected for printing, and therefore the printing system may be programmed with multiple different flow rates for the makeup air, each corresponding to a different type of print medium.

In some examples, the printing system may be configured to automatically and dynamically adjust the airflow rate of the makeup air based on feedback obtained during actual usage. For example, the printing system may scan the images it prints and detect an amount of image blur, adjust the flowrate based on the amount of blur, and repeat this process for successive printed images until a flowrate is converged upon which results in acceptable amounts of image blur. The printing system may continue to check the image blur periodically and adjust the flowrate as needed, which may help to account for changing conditions which could affect the desired flowrate.

Figure 4:
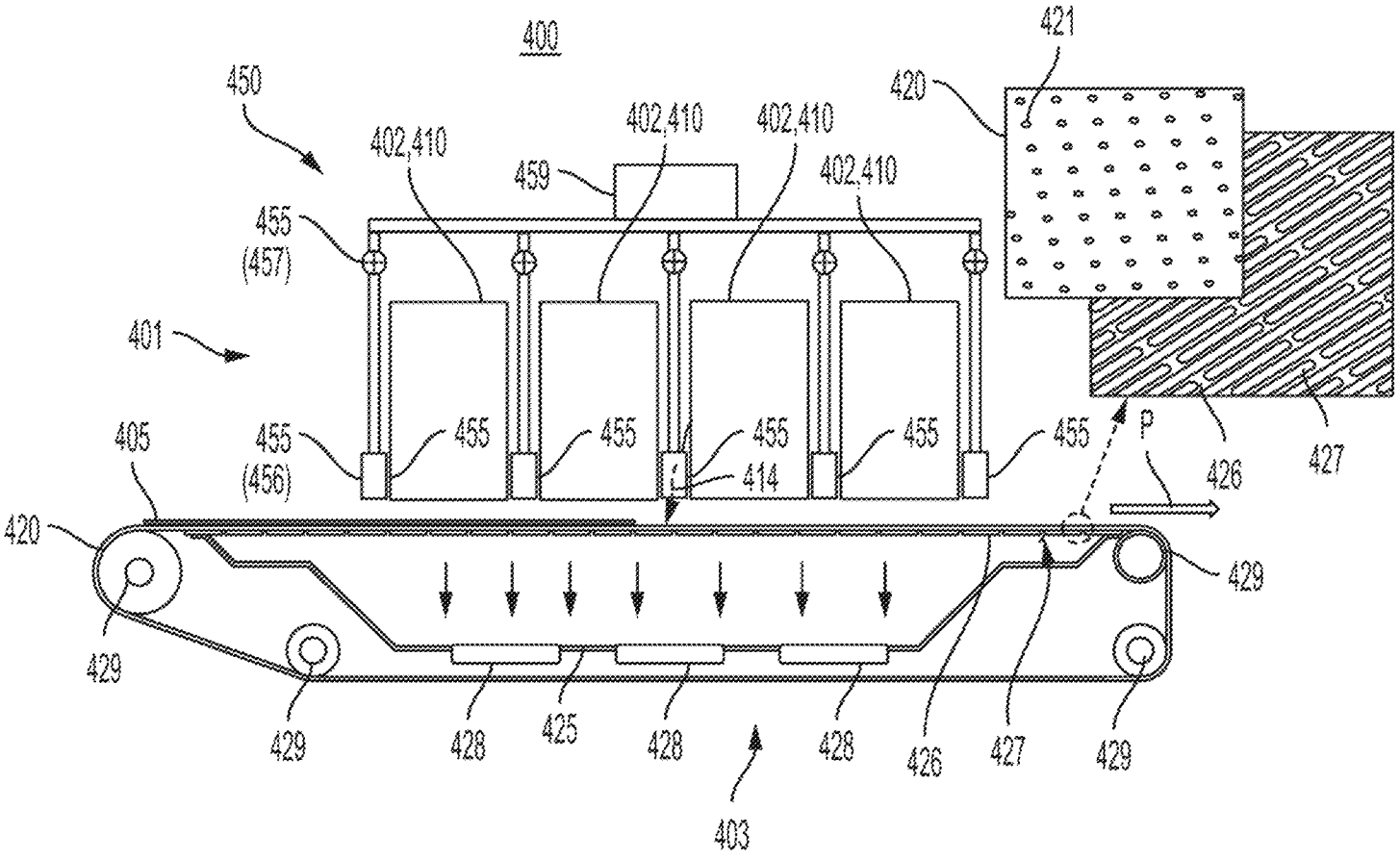
FIG. 4 is a schematic illustration of an ink deposition assembly, media transport device, and airflow control airflow control system of the inkjet printing system of FIG. 3.

FIG. 4 illustrates one example embodiment of a printing system, namely the printing system 400. The printing system 400 can be used as the printing system 100. As illustrated in FIG. 4, the printing system 400 compromises an ink deposition assembly 401, media transport device 403, and airflow control system 450, which can be used as the ink deposition assembly 101, media transport device 103, and airflow control system 150, respectively, which were described above. The printing system 400 may also comprise additional components not illustrated in FIG. 4, such as a control system (e.g., the control system 130).

The ink deposition assembly 401 includes four printheads 110 or four printhead modules 402. The printheads 110/printhead modules 402 are arranged in series along a process direction P above a media transport device 403, such that the print media 405 is transported sequentially beneath each of the printheads 110/printhead modules 402. The media transport device 403 of FIG. 4 comprises a flexible belt providing the movable support surface 420. The movable support surface 420 is driven by rollers 429 to move along a looped path, with a portion of the path passing through the ink deposition region of the ink deposition assembly 401. In this embodiment, the vacuum plenum 425 (such as vacuum plenum 125 of the printing system 100) comprises a vacuum platen 426, which forms a top wall of the plenum 425 and supports the movable support surface 420. The platen 426 comprises platen holes 427, which allow fluidic communication between the interior of the plenum 425 and the underside of the movable support surface 420. The platen holes 427 may include channels on a top side thereof, as seen in the expanded cutaway of FIG. 4, which may increase an area of the opening of the holes 427 on the top side thereof. The holes 421 of the movable support surface 420 are arranged to align with corresponding platen holes 427 as the movable support surface 420 slides across the platen 426. When a hole 421 aligns with a platen holes 427, the environment above the movable support surface 420 becomes fluidically coupled to the vacuum plenum 425, and thus is exposed to the low pressure state of the vacuum plenum 425. Accordingly, a bottom side of a print medium 405 located on the movable support surface 420 is exposed to the low pressure of the vacuum plenum 425 via the holes 426 and 427, and a top side of the print medium 405 is exposed to a higher ambient pressure, and this pressure differential creates a force that holds the print medium 405 against the movable support surface 420.

In another embodiment (not illustrated) of the media transport device 103 of FIG. 2, the movable support surface is a rigid cylindrical drum that is driven to rotate around an axis, with the print media being supported on an outer circumferential surface of the drum. In such an embodiment of the media transport device 103, with which those have ordinary skill in the art are familiar, walls of the drum also serve as the vacuum plenum 125, with the vacuum environment being located inside the drum.

As noted above, FIG. 4 illustrates one embodiment of an airflow control system 450 that can be used as the airflow control system 150 of the printing system 100, which was described above. The airflow control system 450 includes air supply units 455 arranged upstream and downstream of each printhead 410 or printhead module 402. The air supply units 455 each comprise an air guide structure 456 in selective fluid communication with an air source 457. The air guide structure 456 may comprise baffles, nozzles, air knives, tubes, ducts, plenums, or any other structures configured to receive airflows from the air source 457 and direct the airflow towards the movable support surface 420 of the media transport device 403. The air source 457 may comprise a device configured to selectively provide the airflows to the air guide structure 456 at select timings. For example, the air source 457 may comprise a controllable valve that can be opened or closed to selectively provide airflows to the air guide structure 456. In such an example, the controllable valve may receive the airflows from a fan, pump, high pressure chamber, or the like to which the controllable valve is coupled. For example, in FIG. 4 each air source 457 comprises a controllable valve, and each of the controllable valves is fluidically coupled to a shared air chamber 459. The shared air chamber 459 may be provided with pressured air, for example via one or more air moving devices such as fans, pumps, etc. In another embodiment, each air source 457 may comprise its own individual air moving device, such as a fan, pump, etc., which can be controlled to turn on and off at selected timings to selectively provide airflows to the air guide structure 456. Each air guide structure 456 may be positioned adjacent the corresponding printhead module 402 or printhead 410 and near the movable support surface 420, such that the makeup air 414 supplied therefrom flows under the printhead 410/printhead module 402 toward an inter-media zone when the inter-media zone is under the printhead 410/printhead module 402. The timings of supplying makeup air 414 from the air supply units 455 are similar to the timings explained above with reference to FIGS. 3A-3E.

Turning now to FIGS. 5-12, various embodiments of airflow control systems that can be used for the airflow control system 150 or 450 will be described in greater detail below.

Figure 5:
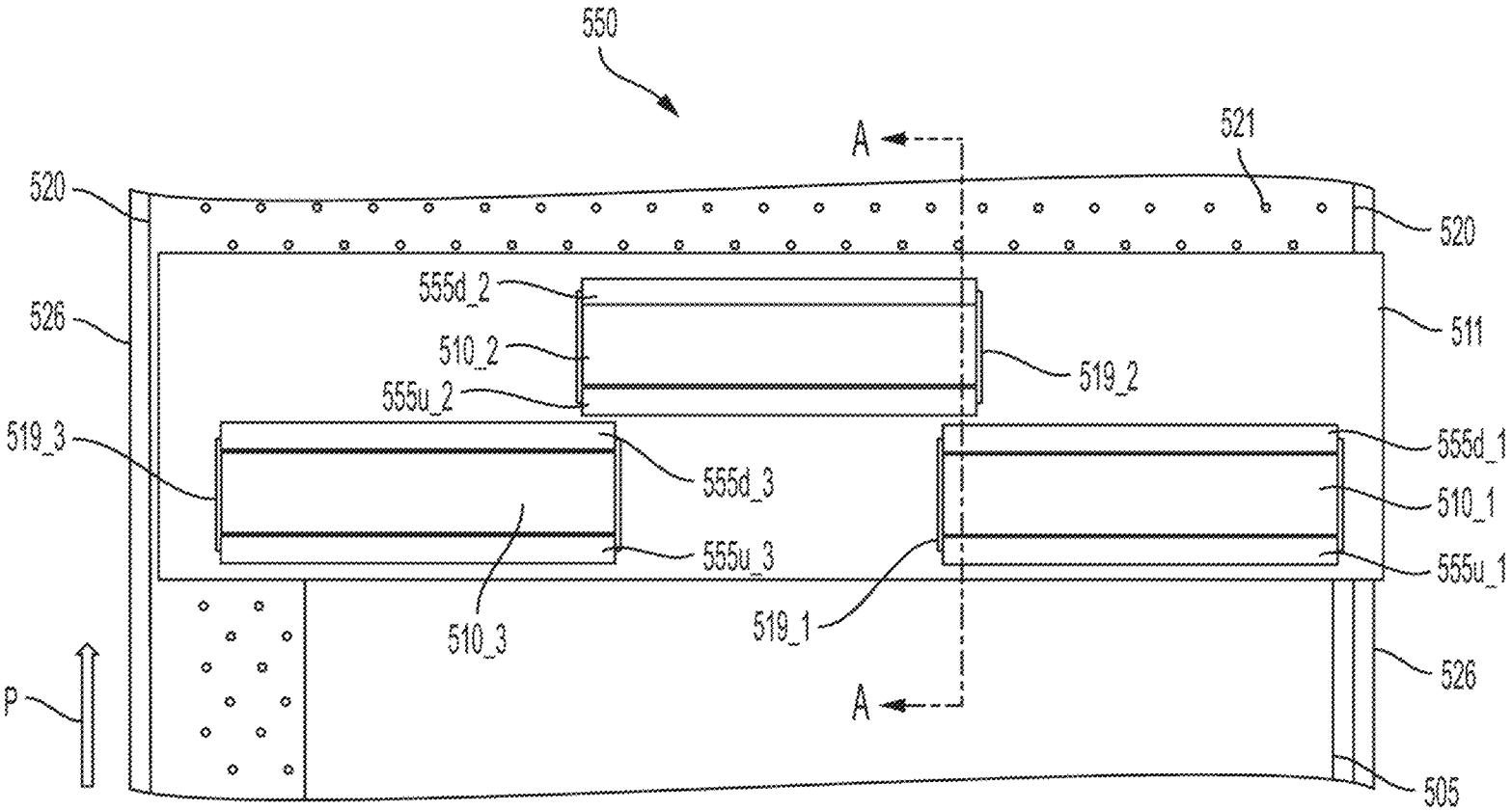
FIG. 5 is a plan view from above the printhead assemblies of one embodiment of an inkjet printing system including an airflow control system.
Figure 6:
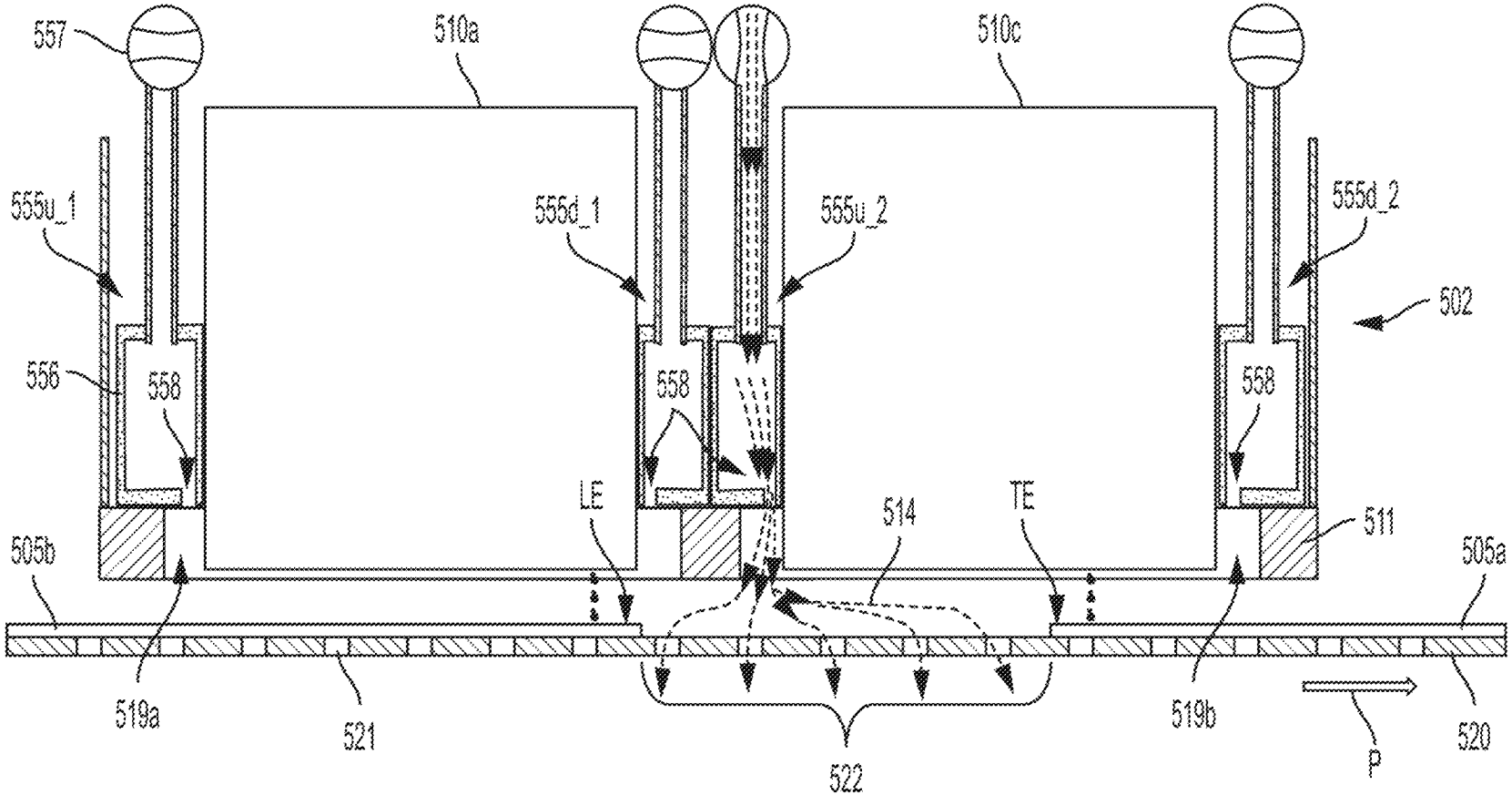
FIG. 6 is a cross-sectional view of the inkjet printing system including an airflow control system of FIG. 5, with the cross-section taken along An in FIG. 5.

FIGS. 5 and 6 illustrate one embodiment of an airflow control system, namely the airflow control system 550. The airflow control system 550 can be used as the airflow control system 150 or 450. The airflow control system 550 can be used in a printing system, such as the printing systems 100 or 400. In FIGS. 5 and 6, the airflow control system 550 is illustrated in the context of an embodiment of a printing system comprising a vacuum platen 526, a movable support surface 520, and one or more printhead modules 502. The vacuum platen 526 can be used as part of the vacuum plenum 125 and/or as the vacuum platen 426. The movable support surface 520, can be used as any of the movable support surfaces 120 and 420. The printhead module 502 can be used as one of the printhead modules 102 and 402. The printhead module 502 comprises printheads 510, which can be used as the printheads 110 or 410. FIG. 5 is a partial plan view of the printing system taken from above the printhead assembly and FIG. 6 is a cross-section taken along the line An in FIG. 5.

In FIGS. 5 and 6, each printhead module 502 comprises three printheads 510 (i.e., printheads 510_1, 510_2, and 520_3) arranged in an offset pattern as illustrated in FIG. 5, but this embodiment is non-limiting, and one of ordinary skill in the art would appreciate the airflow control system 550 could be used in a printing system having differently arranged printhead modules 502. Furthermore, in FIGS. 5 and 6 only one printhead modules 502 is illustrated to simplify the description, but in practice there may be more printhead modules 502 present.

Like the airflow control systems 150 and 450, the airflow control system 510 comprises two or more air supply units, namely the air supply units 555. The air supply units 555 can be used as the air supply units 155, 355, or 455. In the embodiment of FIGS. 5 and 6, the air supply units 555 are provided on a per-printhead 510 basis. In other words, each printhead 510 has a dedicated pair of corresponding upstream and downstream air supply units 555. Thus, for example, a first printhead 510_1 has a corresponding upstream air supply unit 555*u*_1 arranged adjacent to and upstream of the printhead 510_1 and a corresponding downstream air supply unit 555*d*_1 arranged adjacent to and downstream of the printhead 510_1. Similarly, a second printhead 510_2 has a corresponding upstream air supply unit 555*u*_2 and a corresponding downstream air supply unit 555*d*_2, and a third printhead 510_3 has a corresponding upstream air supply unit 555*u*_3 and a corresponding downstream air supply unit 555*d*_3.

In FIGS. 5 and 6, each printhead module 502 comprises a carrier plate 511 with openings 519 through the carrier plate 511. The printheads 510_1, 510_2, and 520_3 are arranged to eject ink through respectively corresponding openings 519_1, 519_2, and 519_3 in a carrier plate 511 of the, with a nozzle end of each printhead 510 extending down partway into the corresponding opening 519 of the carrier plate 511. The air supply units 515 are also arranged to blow the makeup air 514 down through these openings 519 in the carrier plate 511. For example, as shown in FIGS. 5 and 6, there is a small gap around the perimeter of the printheads 510 between the printhead 510 and the edge of the corresponding opening 519, and air outlets 558 of the air supply units 555 are positioned over this gap to blow down through the openings 519.

Similar to the air supply units 155 and 455, the air supply units 555 each comprise an air guide structure 556 in selective fluid communication with an air source 557. The air guide structure 556 may comprise baffles, nozzles, air knives, tubes, ducts, plenums, or any other structures configured to receive airflows from the air source 557 and direct the airflow towards the movable support surface 520 of the media transport device 503. The air source 557 may comprise a device configured to selectively provide the airflows to the air guide structure 556 at select timings. For example, the air source 557 may comprise a controllable valve that can be opened or closed to selectively provide airflows to the air guide structure 556. In such an example, the controllable valve may receive the airflows from a fan, pump, high pressure chamber, or the like to which the controllable valve is coupled. As another example, each air source 557 may comprise its own individual air moving device, such as a fan, pump, etc., which can be controlled to turn on and off at selected timings to selectively provide airflows to the air guide structure 556. Each air guide structure 556 may be positioned adjacent the corresponding printhead module 502 or printhead 510 and near the movable support surface 520, such that the makeup air 515 supplied therefrom flows under the printhead 510/printhead module 502 toward an intermedia zone when the inter-media zone is under the printhead 510/printhead module 502. The timings of supplying makeup air from the air supply units 555 are similar to the timings explained above with reference to FIGS. 3A-3E.

Figure 7:
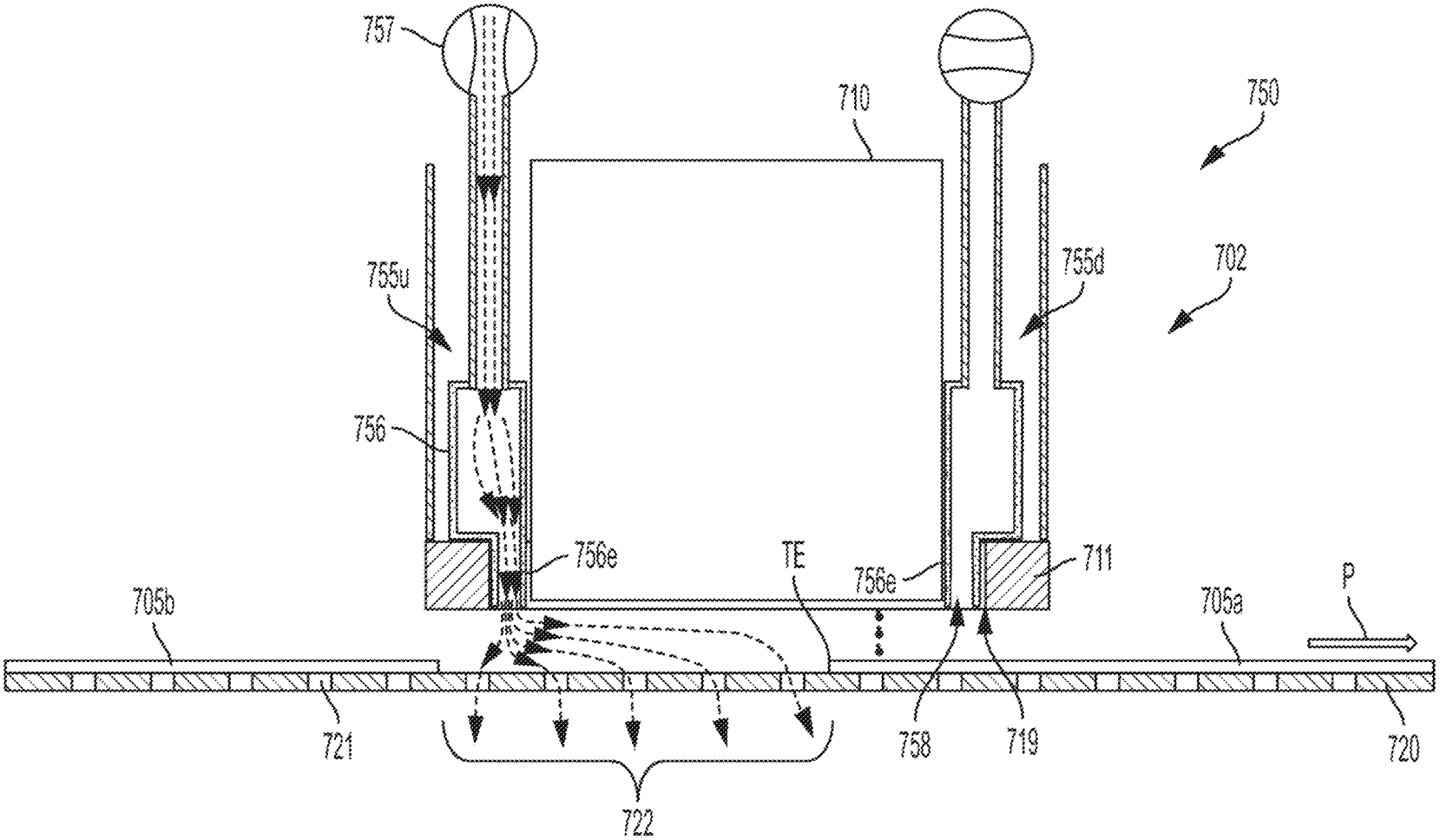
FIG. 7 is a cross-sectional, schematic illustration of components of another embodiment of an inkjet printing system including an airflow control system.

FIG. 7 illustrates another embodiment of an airflow control system, namely the airflow control system 750. The airflow control system 750 can be used as one of the airflow control systems 150 and 450. The airflow control system 750 can be used in a printing system such as the printing systems 100 or 400. In FIG. 7, the airflow control system 750 is illustrated in the context of a printing system comprising a printhead module 702 with one or more printheads 710 and a movable support surface 720. The printhead modules 702, printhead 710, and movable support surfaces 720 may be used as the printhead modules 102 or 402, printheads 110 or 410, and movable support surfaces 120 or 420, respectively. For simplicity, only one printhead 710 and one printhead module 702 is shown, but this embodiment of the airflow control system 750 could be used with any ink deposition assembly having any number and/or arrangement of printheads or printhead modules. For example, the airflow control system 750 could be used with a printhead module such as the printhead module 502.

The airflow control system 750 comprises pairs of air supply units 755 corresponding to each printhead, with an upstream air supply unit 755*u* arranged upstream of the corresponding 710 printhead and a downstream air supply unit 755*d* arranged downstream of the corresponding printhead 710. Similar to the air supply units 155, 455, and 555 the air supply units 755 each comprise an air guide structure 756 in selective fluid communication with an air source 757. The air guide structure 756 may comprise baffles, nozzles, air knives, tubes, ducts, plenums, or any other structures configured to receive airflows from the air source 757 and direct the airflow towards the movable support surface 720 of the media transport device 703. The air source 757 may comprise a device configured to selectively provide the airflows to the air guide structure 756 at select timings. For example, the air source 757 may comprise a controllable valve that can be opened or closed to selectively provide airflows to the air guide structure 756. In such an example, the controllable valve may receive the airflows from a fan, pump, high pressure chamber, or the like to which the controllable valve is coupled. As another example, each air source 757 may comprise its own individual air moving device, such as a fan, pump, etc., which can be controlled to turn on and off at selected timings to selectively provide airflows to the air guide structure 756. Each air guide structure 756 may be positioned adjacent the corresponding printhead module 702 or printhead 710 and near the movable support surface 720, such that the makeup air 715 supplied therefrom flows under the printhead 710/printhead module 702 toward an inter-media zone when the inter-media zone is under the printhead 710/printhead module 702. The timings of supplying makeup air from the air supply units 755 are similar to the timings explained above with reference to FIGS. 3A-3E.

In the embodiment of FIG. 7, the air supply units 755 are provided on a per-printhead 710 basis and are arranged to blow the makeup air 714 down through the openings 719 in a carrier plate 711, similar to the embodiment of FIGS. 5 and 6. However, rather than having an air outlet sitting above the gap between the printhead 710 and the edge of the opening 519, in this embodiment a portion 756*e* of the air guide structure 756 extends down into the opening 719 through the gap. In some examples, the portion 756*e* that extends down into the opening 719 may extend as far as the bottom surface of the printhead 710. Thus, the air outlets 758 of the air supply unit 755 is brought closer to the movable support surface 720, which may improve the effectiveness of the ability of the air supply units 755 to have the makeup air reach the intended locations in the inter-media zone 722 such that the make-up air is better sucked through the uncovered holes 721 in that area so as to address the issues associated with blur.

Figure 8:
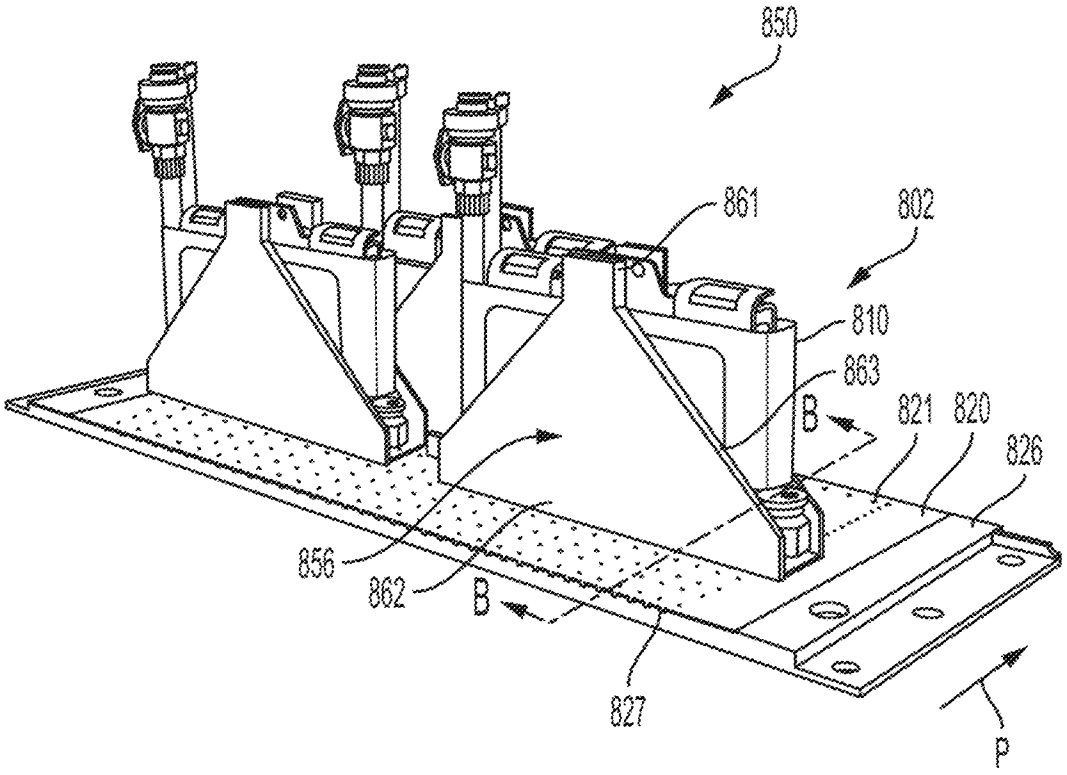
FIG. 8 is a perspective view of yet another embodiment of the components of an inkjet printing system including an airflow control system.
Figure 9:
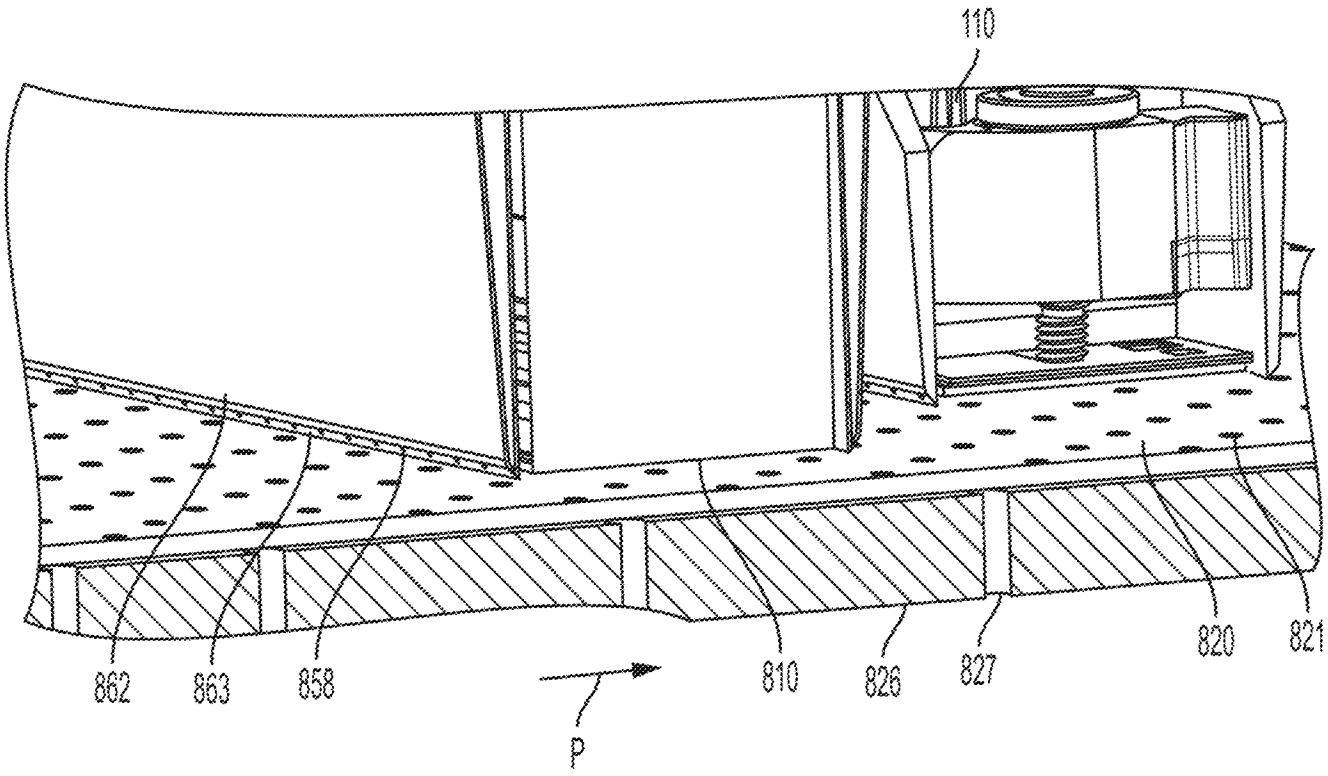
FIG. 9 is a sectional view of another embodiment of the airflow control system, with the cross-section taken along the B in FIG. 8.

FIGS. 8 and 9 illustrate yet another embodiment of an airflow control system, namely the airflow control system 850. The airflow control system 850 can be used as one of the airflow control systems 150, 450, or 750. The airflow control system 850 can be used in a printing system, such as the printing systems 100 or 400. In FIGS. 8 and 9, the airflow control system 850 is illustrated in the context of an embodiment of a printing system comprising a vacuum platen 826, a movable support surface 820, and one or more printhead modules 802 comprising one or more printheads 810. The vacuum platen 826 can be used as part of the vacuum plenum 125 and/or as the vacuum platen 426. The movable support surface 820, can be used as any of the movable support surfaces 120, 450, or 720. The printhead module 802 can be used as any of the printhead modules 102, 402, 502, or 702. The printheads 810, can be used as the printheads 110, 410, 510, or 710.

The airflow control system 850 comprises pairs of air supply units 855 corresponding to each printhead 810, with an upstream air supply unit 855*u* arranged upstream of the corresponding 810 printhead and a downstream air supply unit 855*d* arranged downstream of the corresponding printhead 810. Similar to the air supply units 155, 455, and 555 the air supply units 855 each comprise an air guide structure 856 in selective fluid communication with an air source 857. The air guide structure 856 may comprise baffles, nozzles, air knives, tubes, ducts, plenums, or any other structures configured to receive airflows from the air source 857 and direct the airflow towards the movable support surface 820 of the media transport device 803. The air source 857 may comprise a device configured to selectively provide the airflows to the air guide structure 856 at select timings. For example, the air source 857 may comprise a controllable valve that can be opened or closed to selectively provide airflows to the air guide structure 856. In such an example, the controllable valve may receive the airflows from a fan, pump, high pressure chamber, or the like to which the controllable valve is coupled. As another example, each air source 857 may comprise its own individual air moving device, such as a fan, pump, etc., which can be controlled to turn on and off at selected timings to selectively provide airflows to the air guide structure 856. Each air guide structure 856 may be positioned adjacent the corresponding printhead module 802 or printhead 810 and near the movable support surface 820, such that the makeup air 815 supplied therefrom flows under the printhead 810/printhead module 802 toward an inter-media zone when the inter-media zone is under the printhead 810/printhead module 802. The timings of supplying makeup air from the air supply units 855 are similar to the timings explained above with reference to FIGS. 3A-3E.

More specifically, FIGS. 8 and 9 illustrate a specific implementation of the air guide structures 856 of air supply units 855. FIG. 9 illustrates a sectional view taken along the line B in FIG. 8. The carrier plate and housing of the printhead module 802 are omitted from the illustration to increase visibility. In this example, the air supply units 855 may be provided on a per-printhead 810 basis and may be arranged to blow the makeup air (not shown) down through the openings 819, similar to the embodiments discussed above with respect to FIGS. 4-7, and a portion of the air guide structure 856 may extend down into the opening 819, similar to the embodiment of FIG. 7. As shown in FIG. 8, the air guide structure 156 comprises an air inlet portion 861, an air outlet portion 862, and a transition portion 863. The air inlet portion 861 is relatively narrow in a cross-process direction as compared to the air outlet portion 862. The air outlet portion 1562 may span a width of the printhead 110 in the cross-process direction (the process direction being shown by P in FIG. 8), and may extend down into the opening (such as opening 519 or 719 in FIGS. 5-7, but not shown in FIG. 8) in the gap between the printhead 810 and the edge of the opening. The air guide structure 856 may gradually increase in width throughout the transition portion 863 going from the air inlet portion 861 to the air outlet portion 862. The air inlet portion 861 may be fluidically coupled to an air supply source 857 via, for example, a tube, duct, baffle, pipe, etc. As shown in FIG. 9, air outlet portion 862 may comprise a bottom wall 863 which faces the movable support surface 820 and air outlets 858 may be provided in the bottom wall 863. In FIG. 9, the air outlets 858 are a plurality of holes along a length of the bottom wall 863. In other examples, the air outlets 858 may be one or more slots, nozzles, or any other type of opening. For example, the air outlet 858 may comprise a single slot spanning across the length of the bottom wall 863.

As shown in FIG. 9, in some embodiments the bottom wall 863 may be angled or sloped relative to the movable support surface 820 such that the holes 858 of the bottom wall 863 face slightly toward a reverse-process direction (opposite to the process direction). The angle of the bottom wall 863 relative to the movable support surface 820 may be more than 0° and less than 90°, and in some embodiments it may range from 10° to 45°. For example, the angle may be 20°. Such angling of the bottom wall 863 may reduce the likelihood of a jam occurring in the event that a lead edge LE of a print medium 805 lifts off from the movable support surface 820 as the print medium 805 approaches the printhead 810. In some embodiments, the air outlet portion 862 extends through the opening in the carrier plate such that it is very close to the movable support surface 820, and therefore if a lead edge LE of a print medium 805 lifts up there is a chance that it will strike the air outlet portion 862. By angling the bottom wall 863 of the air outlet portion 862 as shown and described above, then if the lead edge LE lifts up and strikes the air outlet portion 862, the angled bottom wall 863 may deflect the lead edge LE back downward toward the movable support surface 820, thus avoiding a jam. In contrast, if the bottom wall 863 is not angled and lies in a plane generally parallel to the support surface 820, then the lead edge LE may strike the side wall of the air outlet portion 862, and the relatively steep angle of the side wall may result in the lead edge LE being deflected upwards, resulting in a jam of the print medium.

In some embodiments, the air guide structure 856 is configured to snap or attach directly to the printhead 810. In some embodiments, the air guide structure 856 is attached to a housing of the printhead 810 via clips or other snap-fitting attachment features (not illustrated). This capability of snapping or attaching directly to the printhead may allow screws or other such fasteners to be omitted and facilitate easier installation and removal of the air guide structures 856, including easier field installation (e.g., when a printhead 810 needs to be replaced). In other embodiments, the air guide structure 856 may be attached to the printheads 810 by screws or other mechanical fasteners. In other embodiments, the air guide structure 856 may be attached to the housing of the printhead module 102, for example by clips, screws, or any other mechanical fasteners. In some embodiments, the air guide structure 856 is configured to be attachable to existing printheads in already deployed printing systems and sized and shaped to fit through the existing gaps between the carrier plate openings and the printheads. This may facilitate the retrofitting of already deployed printing systems to add in an airflow control system post manufacture. In particular, this may allow for the retrofitting of systems that were not originally designed to have an airflow control system, without requiring new printhead modules, carrier plates, or printheads to also be installed in the printing system.

Figure 10:
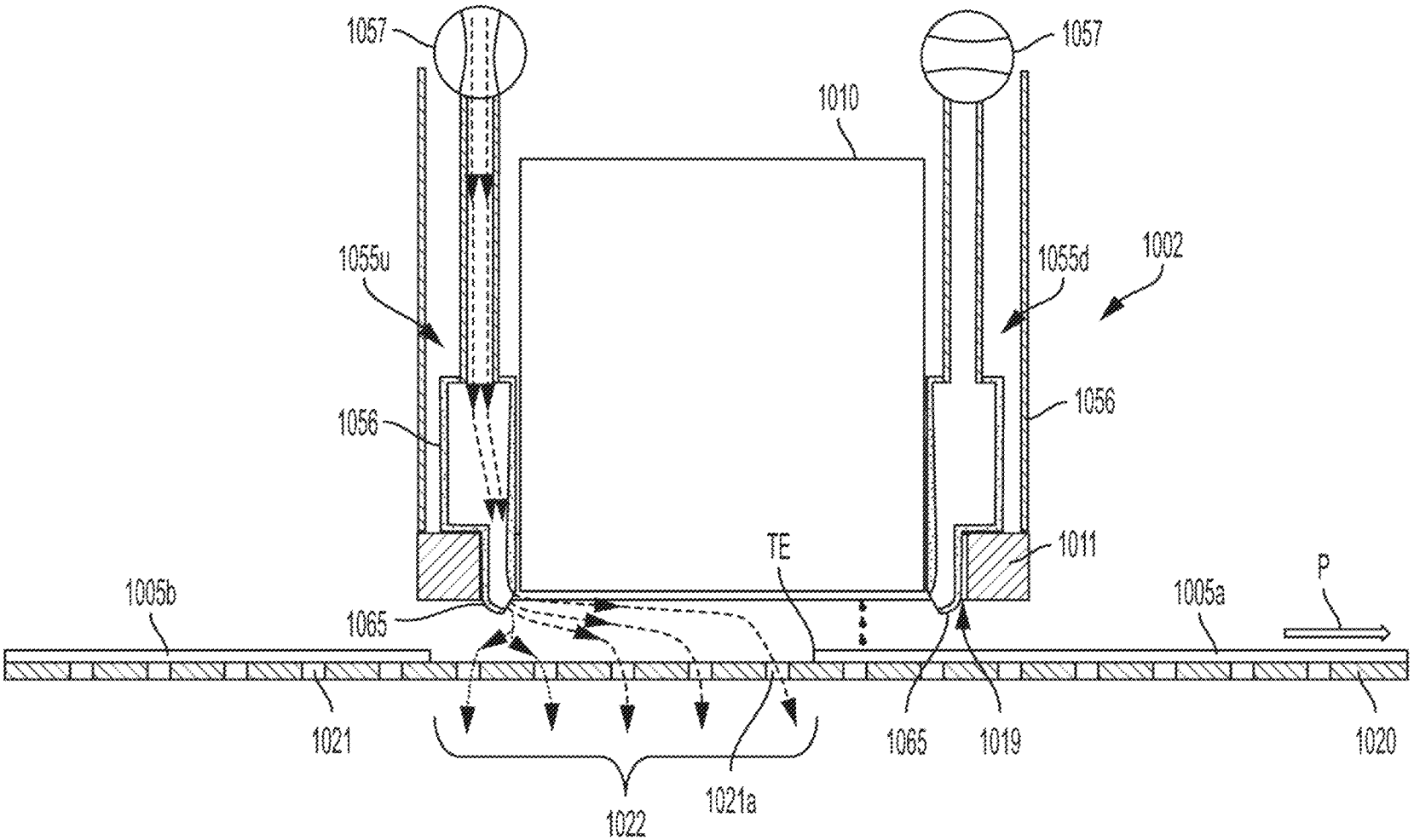
FIG. 10 is a cross-sectional, schematic illustration a yet another embodiment of components of an inkjet printing system including an airflow control system.

FIG. 10 illustrates yet another embodiment of an airflow control system, namely the airflow control system 1050. The airflow control system 1050 can be used as the airflow control system 150 or 450. The airflow control system 1050 can be used in a printing system, such as the printing systems 100 or 400. In FIG. 10, the airflow control system 1050 is illustrated in the context of an embodiment of a printing system comprising a movable support surface 1020 and one or more printhead modules 1002. The movable support surface 1020 can be used as the movable support surface 120 or 420. The printhead module 1002 can be used as the printhead module 102 or 402. The printhead module 1002 comprises printheads 1010, which can be used as the printheads 110 or 410. For simplicity, only one printhead 1010 and one printhead module 1002 are shown in FIG. 10, but this embodiment of the airflow control system 1050 could be used with any ink deposition assembly with any number of printheads 1010 and printhead modules 1002.

The airflow control system 1050 comprises pairs of air supply units 1055 corresponding to each printhead, with an upstream air supply unit 1055*u* arranged upstream of the corresponding 1010 printhead and a downstream air supply unit 1055*d* arranged downstream of the corresponding printhead 1010. In this example, the air supply units 1055 are provided on a per-printhead 1010 basis and may be arranged to blow the makeup air 1014 down through the openings 1019 (for simplicity makeup air 1014 is shown only being supplied from air supply unit 1055*u*, but it can also be supplied from air supply unit 1055*d* as in other embodiments), similar to the embodiments of FIGS. 4-9 described above. Similar to the air supply units 155, 455, and 555, 755, and 855 the air supply units 1055 each comprise an air guide structure 1056 in selective fluid communication with an air source 1057. The air guide structure 1056 may comprise baffles, nozzles, air knives, tubes, ducts, plenums, or any other structures configured to receive airflows from the air source 1057 and direct the airflow towards the movable support surface 1020 of the media transport device 1003. The air source 1057 may comprise a device configured to selectively provide the airflows to the air guide structure 1056 at select timings. For example, the air source 1057 may comprise a controllable valve that can be opened or closed to selectively provide airflows to the air guide structure 1056. In such an example, the controllable valve may receive the airflows from a fan, pump, high pressure chamber, or the like to which the controllable valve is coupled. As another example, each air source 1057 may comprise its own individual air moving device, such as a fan, pump, etc., which can be controlled to turn on and off at selected timings to selectively provide airflows to the air guide structure 1056. Each air guide structure 1056 may be positioned adjacent the corresponding printhead module 1002 or printhead 1010 and near the movable support surface 1020, such that the makeup air 1015 supplied therefrom flows under the printhead 1010/printhead module 1002 toward an inter-media zone when the inter-media zone is under the printhead 1010/printhead module 1002. The timings of supplying makeup air from the air supply units 1055 are similar to the timings explained above with reference to FIGS. 3A-3E.

A portion of the air guide structure 1056 may extend down into the opening 1019, as in the embodiments of FIGS. 7-9. In this embodiment, the air guide structure 1056 may further comprise a directed air outlet portion 1065 that is configured to eject the makeup air 1014 in a direction that is angled under the printhead 1010, rather than ejecting the makeup air 1014 straight downwards towards the movable support surface 1020. Thus, an upstream air supply unit 1055*u* may guide the makeup air 1014 such that its initial direction is angled downstream under the printhead 1010, while a downstream air supply unit 1055*d* may guide the makeup air 1014 such that its initial direction is angled upstream under the printhead 1010. In some circumstances, this helps the makeup air 1014 to be able to flow further to reach uncovered holes 1021 that are relatively far from the air supply unit 1055. Without such directing of the makeup air 1014, in some circumstances the makeup air 114 may have a harder time reaching those distant holes 1021. For example, in the situation illustrated in FIG. 10, the trail edge TE is near the downstream side of the printhead 1010, and therefore hole 1021*a* is relatively distant from the air supply unit 1055*u*. If the initial flow direction of the makeup air 114 after ejection were straight down, then more of the makeup air 114 would be sucked into the nearer holes 1021 and less of the makeup air 114 would make it all the way over to the distant hole 1021*a*. Thus, the pressure near the distant hole 1021*a* may be lower than desired. In contrast, if the upstream air supply unit 1055*u* directs its makeup air to initially blow in a generally downstream direction as illustrated in FIG. 10, more of the makeup air 114 is able to reach the relatively distant hole 1021*a* than would have otherwise been the case. This may improve the blur reduction effect in some circumstances.

Figure 11:
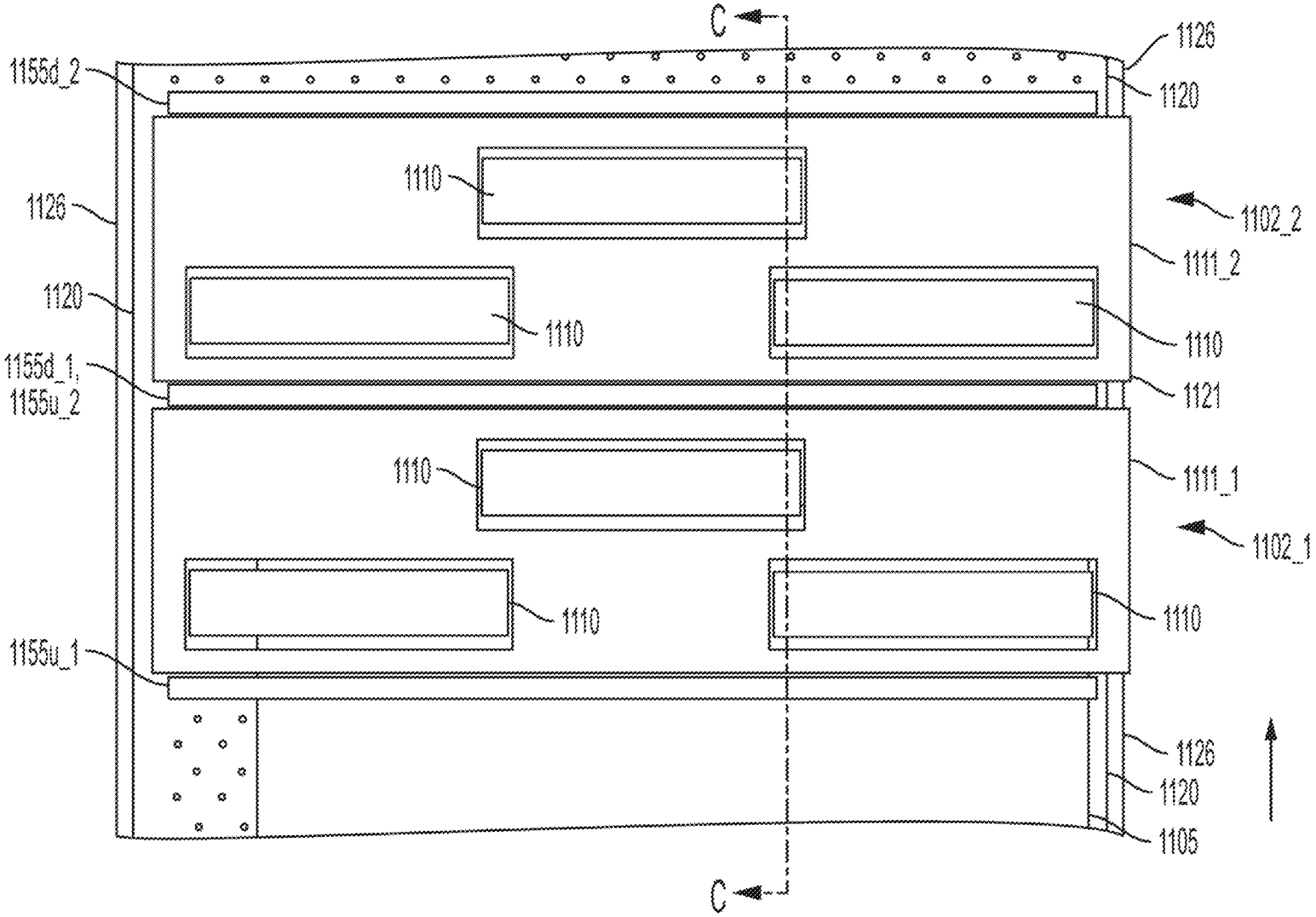
FIG. 11 is a schematic, plan view from above the printhead assemblies of another embodiment of an inkjet printing system including an airflow control system.
Figure 12:
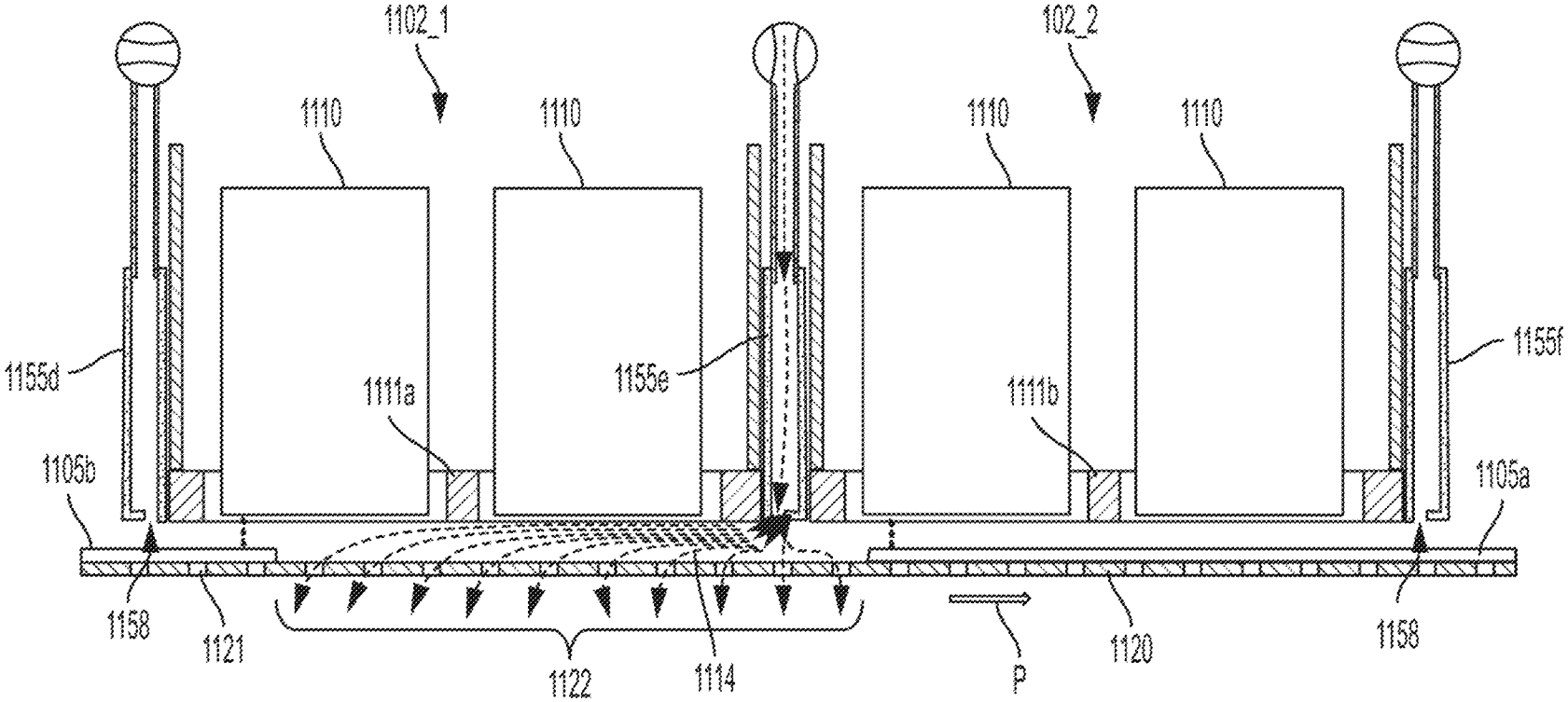
FIG. 12 is a cross-sectional view of the inkjet printing system of FIG. 11, with the cross-section taken along C in FIG. 11.

FIGS. 11 and 12 illustrate yet another embodiment of an airflow control system, namely airflow control system 1150. The airflow control system 1150 can be used as the airflow control system 150 or 450. The airflow control system 1150 can be used in a printing system, such as the printing system 100 or 400. In FIGS. 11 and 12, the airflow control system 1150 is illustrated in the context of an embodiment of a printing system comprising a vacuum platen 1126, a movable support surface 1120, and one or more printhead modules 1102. The vacuum platen 1126 can be used as part of the vacuum plenum 125 and/or as the vacuum platen 426. The movable support surface 1120, can be used as any of the movable support surfaces 120 and 420. The printhead module 1102 can be used as one of the printhead modules 102 and 402. The printhead module 1102 comprises printheads 1110, which can be used as the printheads 110 or 410. FIG. 12 illustrates a cross-section taken along the line C in FIG. 11.

In this embodiment, the air supply units 1155 are provided on a per-printhead-module 1102 basis, rather than on a per-printhead 1110 basis. Thus, each printhead module 1102 has its own pair of corresponding upstream and downstream air supply units 1155, and the printheads 1110 within the same module 1102 may share the air supply units 1155 of that module 1102. Thus, for example, a first printhead module 1102_1 has a corresponding upstream air supply unit 1155*u*_1 arranged adjacent to and upstream of the printhead module 1102_1 and a corresponding downstream air supply unit 1155*d*_1 arranged adjacent to and downstream of the printhead module 1102_1. Similarly, a second printhead module 1102_2 has a corresponding upstream air supply unit 1155*u*_2 and a corresponding downstream air supply unit 1155*d*_2. In some embodiments, the same air supply unit 1155 may serve as both a downstream air supply unit 1155*d* with respect to one printhead module 1102 and an upstream air supply unit 1155*u* with respect to another printhead module 1102—for example, the air supply unit labeled 1155*d*_1, 1155*u*_2 in FIG. 11 is the downstream air supply unit 1155*d*_1 of the first printhead module 1102_1 and also the upstream air supply unit 1155*u*_2 of the second printhead module 1102_2. In the embodiment of FIGS. 11 and 12, the air supply units 1155 may extend in a cross-process direction across a width of the deposition region of the ink deposition assembly 1101 (with the process direction labeled as P in FIG. 11). In some circumstances, providing the air supply units 1155 on a per-printhead module 1102 basis may be beneficial in that the air supply units 1155 do not have to be arranged within a housing of the printhead modules 1102. In some systems, there may not be sufficient space within the printhead modules 1102 for an air supply unit 1155, while there may be sufficient space between printhead modules 1102.

Similar to the air supply units 155, 455, 755, 855, and 1055, the air supply units 1155 each comprise an air guide structure 1156 in selective fluid communication with an air source 1157. The air guide structure 1156 may comprise baffles, nozzles, air knives, tubes, ducts, plenums, or any other structures configured to receive airflows from the air source 1157 and direct the airflow towards the movable support surface 1120 of the media transport device 1103. The air source 1157 may comprise a device configured to selectively provide the airflows to the air guide structure 1156 at select timings. For example, the air source 1157 may comprise a controllable valve that can be opened or closed to selectively provide airflows to the air guide structure 1156. In such an example, the controllable valve may receive the airflows from a fan, pump, high pressure chamber, or the like to which the controllable valve is coupled. As another example, each air source 1157 may comprise its own individual air moving device, such as a fan, pump, etc., which can be controlled to turn on and off at selected timings to selectively provide airflows to the air guide structure 1156. Each air guide structure 1156 may be positioned adjacent the corresponding printhead module 1102 and near the movable support surface 1120, such that the makeup air 1114 supplied therefrom flows under the printhead module 1102 toward an inter-media zone when the inter-media zone is under the printhead module 1102. The timings of supplying makeup air from the air supply units 1155 are similar to the timings explained above with reference to FIGS. 3A-3E.

Figure 13:
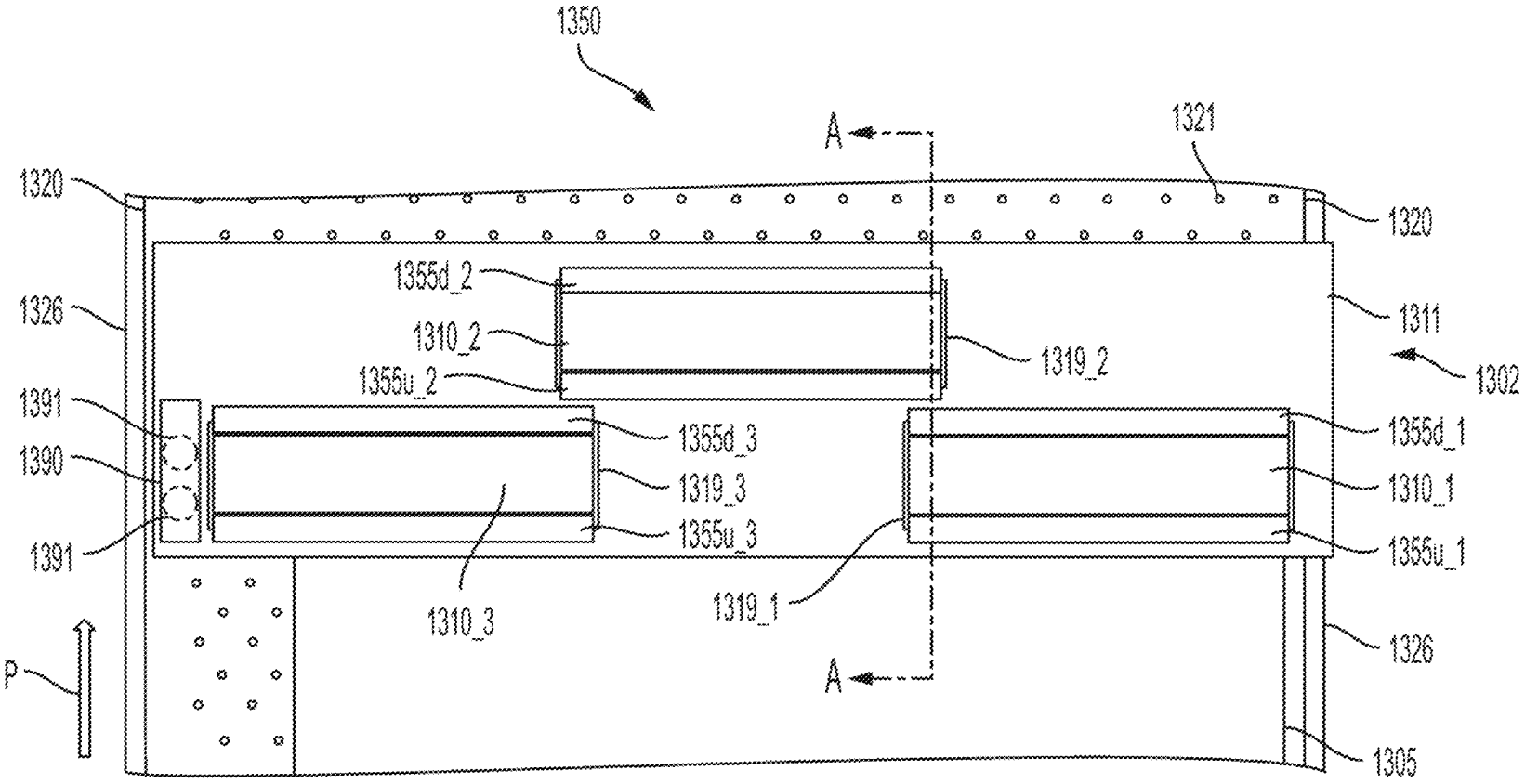
FIG. 13 is a plan view from above the printhead assemblies of one embodiment of an inkjet printing system including an airflow control system.

FIG. 13 illustrates one embodiment of an airflow control system, namely the airflow control system 1350. The airflow control system 1350 can be used as the airflow control system 150 or 450. The airflow control system 1350 can be used in a printing system, such as the printing systems 100 or 400. In FIG. 13, the airflow control system 550 is illustrated in the context of an embodiment of a printing system comprising a vacuum platen 1326, a movable support surface 1320, and one or more printhead modules 1302. The vacuum platen 1326 can be used as part of the vacuum plenum 125 and/or as the vacuum platen 426. The movable support surface 1320, can be used as any of the movable support surfaces 120 and 420. The printhead module 1302 can be used as one of the printhead modules 102 and 402. The printhead module 1302 comprises printheads 1310, which can be used as the printheads 110 or 410. FIG. 13 is a partial plan view of the printing system taken from above the printhead assembly.

In FIG. 13, each printhead module 1302 comprises three printheads 1310 (i.e., printheads 1310_1, 1310_2, and 1320_3) arranged in an offset pattern as illustrated in FIG. 13, but this embodiment is non-limiting, and one of ordinary skill in the art would appreciate the airflow control system 1350 could be used in a printing system having differently arranged printhead modules 1302. Furthermore, in FIG. 13 only one printhead modules 1302 is illustrated to simplify the description, but in practice there may be more printhead modules 1302 present.

In the embodiment of FIG. 13, each printhead module 1302 comprises a carrier plate 1311 and one or more ports 1391 are provided along a side of the carrier plate 1311. The ports 1391 comprise holes or openings through the carrier plate 1311. In FIG. 13, two ports 1391 configured as circular holes are illustrated, but in practice any number of ports 1391 could be provided and the ports 1391 could have any desired shape, such as a slot. In this embodiment, the airflow control system 1350 comprises one or more air supply units 1390 arranged to supply makeup air through the ports 1391 to neutralize the vacuum suction from uncovered holes 1321 along the side of the movable support surface 1320.

Because the print media 1305 are registered to one side of the platen 1326, the holes 1321 on the opposite side will be uncovered if the print medium 1305 is less wide than the largest print medium 1305 the system is designed to handle. For example, in FIG. 13 four columns of holes 1321 on an inboard side (left side) of the movable support surface 1320 are uncovered. These uncovered holes 1321 may create crossflows which can contribute to blurring along a side edge of the print medium, for reasons similar to those described above with respect to the lead and trail edges. Thus, the ports 1391 are provided along a side of the carrier plate 1311 that is opposite from the side to which the print media 1305 are registered such that the makeup air provided through the ports 1301 can neutralize the vacuum suction through those uncovered holes 1321 in the vicinity of the printhead 1310. In FIG. 13 the print media 1305 are registered to an outboard side of the platen 1326 (right side in FIG. 13), and thus in FIG. 13 the ports 1390 are provided on the inboard side of the carrier plate 1311 (left side in FIG. 13). By providing makeup air through the ports 1390, the crossflows near the side edges of the print media 1305 may be reduced or eliminated, thus reducing or eliminating image blur along the side edges off the print media 1305.

Unlike the other air supply units described herein, the air supply unit(s) 1390 are not controlled to supply makeup air based on the location of the inter-media zones. This is because the uncovered hole 1321 along the side edge of the print medium 1305 are present throughout the printing process regardless of the location of the inter-media zone. Thus, the air supply unit(s) 1390 are configured to supply makeup air through the ports 1390 whenever a print medium 1305 is being printed on by a printhead 1310 adjacent the ports 1390, unless the print medium 1305 is wide enough to cover all of the holes 1321 in a cross-process direction. In some examples, the air supply unit(s) 1390 may supply the makeup air continuously during printing.

In some embodiments, the amount of makeup air supplied by an air supply unit 1390 is controlled based on the size of the print medium 1305 being printed, or in other words based on the number of columns of holes 1321 that are left uncovered by the print medium 1305. The more holes 1321 left uncovered, the more makeup air may be supplied, so that the amount of makeup air supplied is sufficient to neutralize the vacuum suction near the printhead 1310 to reduce crossflows while not being too large and creating its own crossflows. The amounts of air to supply for each size of print media 1305 may be determined in advance experimentally, in the same manner as described above in relation to the air supply units 155. The amounts of air to supply may also be learned and adjusted automatically by the printing system during operation, in the same manner as described above in relation to adjusting the timings of supplying makeup air from the air supply units 155.

In some embodiments, the airflow control system 1350 also comprises air supply units 1355 arranged around the printheads 1310 or printhead modules 1302 and configured to supply makeup air based on the location of an intermedia zone. For example, in FIG. 13 the printheads 1310_1, 1310_2, and 1320_3 are arranged to eject ink through respectively corresponding openings 1319_1, 1319_2, and 1319_3 in the carrier plate 1311, and the air supply units 1315 are also arranged to blow makeup air down through these openings 1319 in the carrier plate 1311, similar to the air supply units 155, 455, and 555 described above. The timings of supplying makeup air from the air supply units 1355 are similar to the timings explained above with reference to FIGS. 3A-3E.

Figure 14:
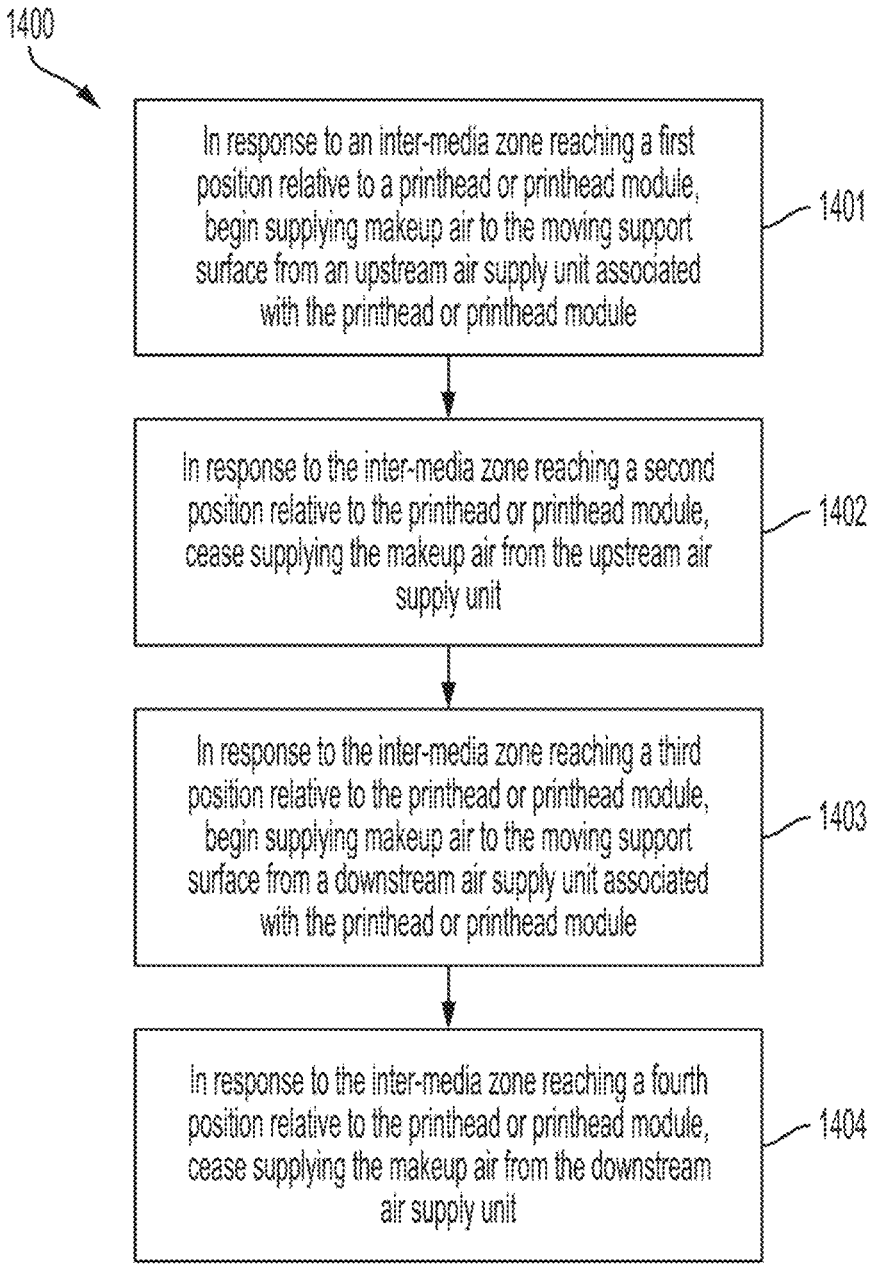
FIG. 14 is a workflow diagram of a method of operating an airflow control system of an inkjet printing system according to an embodiment.
Figure 16:
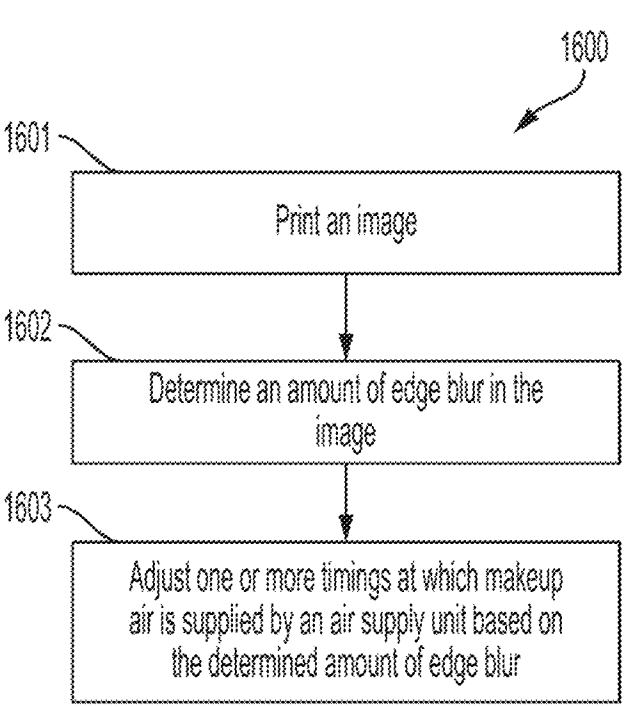
FIG. 16 is a workflow diagram of a method for controlling airflow from an airflow control system according to an embodiment.
Figure 15:
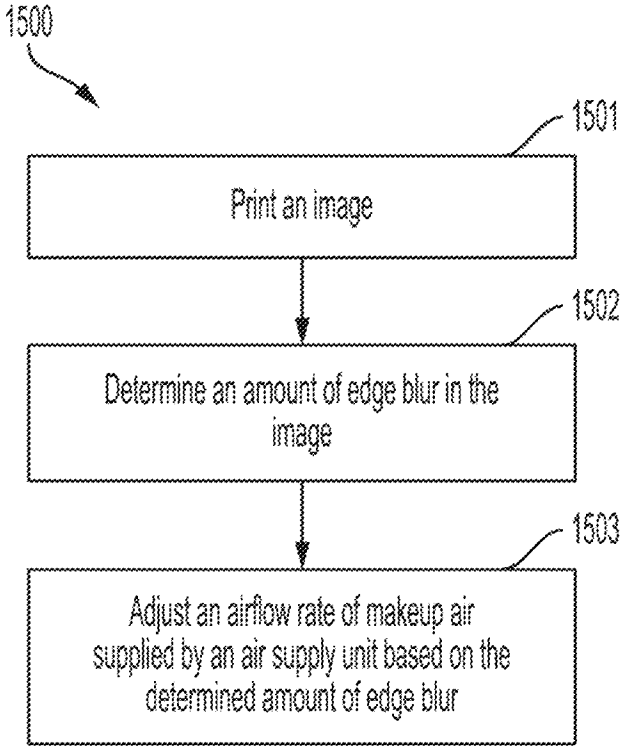
FIG. 15 is a workflow diagram of a method for controlling airflow from an airflow control system according to an embodiment.

FIGS. 14-16 illustrate exemplary embodiments of methods 1400, 1500, and 1600 of operating a printing system, respectively. The methods 1400, 1500, 1600 may be performed in an inkjet printing system comprising a media transport device that utilizes vacuum suction to hold print media against a movable support surface as the movable support surface transports the print media through a deposition region of an ink deposition assembly, such as any of the printing system 100 or 400 and any other embodiments of the printing systems described above. The printing system may have an airflow control system, such as the airflow control system 150, 450, 550, 750, 850, 1050, or 1150, which comprises air supply units associated with printheads or printhead modules, as described above. The method may be performed, for example, by a control system of the printing system. For example, a machine-readable medium may store machine readable instructions that, when executed, cause the control system to perform operations of one or more of the methods, for example by generating instructions or signals to control operations of the airflow control system and/or to control other components of the printing system. Although various other components of the printer may participate in the performance of the operations, the control system may be considered as performing the operations because the control system directs and controls the operations of those components. In addition, the methods may be performed, for example, by a user of the printer by virtue of the user placing the printer in an operational state in which the printer performs the operation.

FIG. 14 illustrates a method 1400 pertaining to controlling the supply of makeup air from a pair of air supply units associated with a printhead or printhead module. The method 1400 comprises operations illustrated in blocks 1401 through 1404 of FIG. 14, which are described in greater detail below.

Operations of block 1401 comprise, in response to an inter-media zone reaching a first position relative to a printhead or printhead module, beginning to supply makeup air to the movable support surface from an upstream air supply unit associated with the printhead or printhead module. Operations of block 1401 may include determining that the inter-media zone has reached the first position. In some embodiments, the first position of the inter-media zone is a position in which the trail edge of a print medium adjacent to and upstream of the inter-media zone is at a location on an upstream side of a printhead, such as a location near or aligned with an upstream edge of the printhead or printhead module. Determining the inter-media zone has reached the first position can include sensing, for example, by a location tracking system, a location of the print medium adjacent and upstream of the inter-media zone and determining, based on the sensed location, when the trailing edge of the print medium is at the location on the upstream side of the printhead. Sensing a location of the print medium may include sensing a lead edge or trail edge of the print medium using an edge sensor.

Operations of block 1402 comprise, in response to the inter-media zone reaching a second position relative to the printhead or printhead module, ceasing supply of the makeup air from the upstream air supply unit. Operations of block 1402 may also include determining that the inter-media zone has reached the second position. In some examples, the second position of the inter-media zone is a position in which the trail edge of the print medium adjacent to and upstream of the inter-media zone is at a location on a downstream side of a printhead, such as a location near or aligned with a downstream edge of the printhead or printhead module. In some examples, the second position of the inter-media zone is a position in which the lead edge of a second print medium adjacent the inter-media zone is at a location on an upstream side of a printhead, such as a location near or aligned with an upstream edge of the printhead or printhead module. The second location is different than, and downstream of, the first location. Determining the inter-media zone has reached the second position can include sensing, for example, by a location tracking system, locations of a print medium and determining, based on the sensed locations, when the trailing edge or lead edge of the print medium is at the corresponding location mentioned above. Sensing a location of the print medium may include sensing a lead edge or trail edge of the print medium using an edge sensor.

Operations of block 1403 comprise, in response to the inter-media zone reaching a third position relative to the printhead or printhead module, beginning to supply makeup air from a downstream air supply unit associated with the printhead or printhead module. Operations of block 1402 may also include determining that the inter-media zone has reached the third position. In some examples, the third position of the inter-media zone is a position in which the trail edge of the first print medium is at a location on a downstream side of a printhead, such as a location near or aligned with a downstream edge of the printhead or printhead module. In some examples, the third position of the inter-media zone is a position in which the lead edge of the second print medium is at a location on an upstream side of a printhead, such as a location near or aligned with an upstream edge of the printhead or printhead module. In some examples, the third position is the same as the second position, in which case operations of blocks 302 and 303 may be performed simultaneously. In other examples, the third location may be different than (either upstream or downstream of) the second position. Determining the inter-media zone has reached the third position can include sensing, for example, by a location tracking system, locations of a print medium and determining, based on the sensed locations, when the trailing edge or lead edge of the print medium is at the corresponding location mentioned above. Sensing a location of the print medium may include sensing a lead edge or trail edge of the print medium using an edge sensor.

Operations of block 1404 comprise, in response to the inter-media zone reaching a fourth position relative to the printhead or printhead module, cease supplying the makeup air from the downstream air supply unit. Operations of block 1402 may also include determining that the inter-media zone has reached the fourth position. In some examples, the fourth position of the inter-media zone is a position in which the lead edge of second print medium is at a location on a downstream side of a printhead, such as a location near or aligned with an upstream edge of the printhead or printhead module. Determining the inter-media zone has reached the fourth position can include sensing, for example, by a location tracking system, locations of a print medium and determining, based on the sensed locations, when the lead edge of the print medium is at the corresponding location mentioned above. Sensing a location of the print medium may include sensing a lead edge or trail edge of the print medium using an edge sensor.

In the operations of blocks 1401 and 1403, beginning to supply the makeup air from one of the air supply units may comprise generating and supplying an airflow-on control signal and/or power supply signal to the relevant air supply unit, the airflow-on control signal and/or power supply signal being configured to turn on airflow of an air supply source of the air supply unit. In some examples, the air supply source may be a valve, and turning on the airflow of the air supply source may comprise moving the valve from a closed state to an open state. In some examples, the air supply source may be an air moving device (e.g., fan, pump, etc.), and turning on the airflow of the air supply source may comprise supplying motive power to a rotor of the air moving device.

Conversely, in the operations of blocks 1402 and 1404, ceasing supplying the makeup air may comprise generating and supplying an airflow-off control signal and/or ceasing to supply a power supply signal to the relevant air supply unit, the airflow-off control signal being configured to turn off airflow of the air supply source of the air supply unit. In some examples, the air supply source may be a valve, and turning off the airflow of the air supply source may comprise moving the valve from an open state to a closed state. In some examples, the air supply source may be an air moving device (e.g., fan, pump, etc.), and turning off the airflow of the air supply source may comprise ceasing to supply motive power to a rotor of the air moving device.

FIG. 15 illustrates an embodiment of a method 1500 for determining an airflow rate to use for the makeup air of an air supply unit. In one embodiment, the method 1500 may be performed automatically by the control system of the printing system, and thus in some embodiments the airflow rate may be dynamically adjusted during printing.

Block 1501 comprises printing an image using a printing system comprising an airflow control system according to the various embodiments described herein. In one embodiment, the image may be a test image generated specifically for the airflow rate adjustment process. The test image may comprise a one or more printed features (e.g., one or more lines) have a predetermined pattern or shape. For example, the test image may comprise one or more lines extending in the cross-process direction, printed near one or both of the lead and trail edges. The line may be, for example, a few (e.g., two, three, four, five, etc.) pixels wide. In another embodiment, the image may not be specific to the airflow rate adjustment process—for example, the image may be part of a regular print job unrelated to the adjustment process.

Block 1502 comprises determining an amount of edge blur in the printed image. This may involve obtaining an electronic copy of the printed image, for example by scanning or photographing the printed image. An inline image capture system can be used to scan the printed images while they are still being transported through the printing system. The copied image may then be analyzed to determine an amount of blur in the image. Analyzing the copied image may include measuring the amount of ink that landed outside of an intended deposition area associated with a printed feature (e.g., a line) in the printed image, and this quantity may represent the amount of blur in the image. Determining the amount of ink that landed outside of the intended deposition area may involve identifying where the intended deposition area is located in the copied image. The location and shape of the intended inked area for a printed feature may be determined, for example, by edge detection or other image processing techniques and/or based on the master image file used to print the image. Once the boundaries of the intended deposition region are determined, the number of dots in the printed image that are beyond the edge of the intended deposition region may be counted, and this value may be used to characterize the extent of the edge blur, with more dots being indicative of more image blur. Experimentally, it has been determined that having less than 20 drops/mm$^2$ outside the intended inked region is acceptable with respect to image blur, in some circumstances. Alternatively, or in addition, the number of dark pixels that are outside of the intended deposition region in the copied image may be determined, and this value may be used to characterize the extent of the edge blur, with more dark pixels being indicative of more edge blur. Alternatively, or in addition, the average brightness value of the pixels in a given region in the copied image that is outside of the intended deposition region may be determined, and this value may be used to characterize the extent of the edge blur, with lower average brightness being indicative of more edge blur.

In examples that use edge detection to identify the boundary of the intended inked area, the boundary (edge) may be identified by analyzing the local density of inked dots in the printed image (local average darkness of pixels in the copied image). Ideally, the edges of the printed feature would transition in a sharp, binary fashion from inked (e.g., dark) to non-inked (e.g., white) and vice versa. In reality, due to manufacturing tolerances, environmental conditions, etc., the edges of a printed feature tend to transition from inked to non-inked over a finite distance. Accordingly, the edge of the intended inked region can be defined as the contour (e.g., line) where the localized average print density falls below a threshold. For example, if an ideal inked region of the print has a localized average greyscale value of 255 (8 bit grayscale) and the ideal non-inked region has a localized average greyscale value of 0 (8 bit grayscale), then the edge of the intended inked region could be determined to be the boundary where the localized average greyscale falls below 80.

Alternatively, the boundaries of the printed feature (e.g., line) may be inferred based on knowledge of the dimensions of the printed features. For example, if the printed feature is a line and it is known that the line is supposed to be four (4) pixels wide, then the system may identify a center of the printed line in the copied image and determine that the boundaries (edges) of the line are each located on opposite sides of and two pixels from this center.

Various other known image processing techniques, image quality analysis techniques, barcode quality analysis techniques, and blur detection techniques may also be used to quantify the extend of the image blur. As another example, the techniques for measuring blur disclosed in U.S. patent application Ser. No. 16/818,847, filed on Mar. 13, 2020, which is incorporated herein by reference in its entirety, may be used to determine the amount of edge blur.

Block 1503 comprises adjusting the flow rate of the makeup air supplied by an air supply unit based on the determined amount of edge blur. For example, the amount of edge blur may be used as feedback in a control loop, such as a proportional-integral-derivative (PID) control loop, with the airflow rate being the controlled variable. For example, the larger the amount of edge blur, the greater the amount by which the airflow rate is adjusted. The airflow rate may be adjusted by, for example, adjusting the airflow source of the air supply unit. For example, if the airflow source comprises a valve with variable settings for the size of its opening—i.e., the valve can be partially open to various degrees, as opposed to being just fully open or fully closed—then the flowrate can be adjusted by adjusting the opening size of the valve. As another example, if the airflow source comprises (or is coupled to) an air moving device (e.g. fan), the flowrate of the air moving device may be adjusted (e.g., the fan speed). As another example, a mass flow controller may be coupled to the airflow source, and the mass flow controller may be controlled to adjust the airflow rate. For example, a baffle in a flow path of the air may be moved to increase or decrease an area of an opening in the flow path, thereby adjusting the flowrate of the air through the path. Those having ordinary skill in the art would understand a combination of any of these mechanisms can be implemented to adjust the flow rate and would further appreciate other techniques for adjusting the flow rate.

In some embodiments, the airflow rate of all of the air supply units may be set to the same level and may be adjusted together. In other embodiments, the airflow rate of individual air supply units or of groups of air supply units may be adjusted independently. In such cases, portions of the method 1500 may be performed multiple times, for example, once for each air supply unit or group of air supply units.

FIG. 16 illustrates an embodiment of a method 1600 pertaining to determining timings at which the makeup air of an air supply unit is supplied. In one example, the method 1600 may be performed automatically by the control system of the printer, and thus in some examples the timings of the makeup air may be dynamically adjusted during usage. The method 1600 comprises the operations of blocks 1601-1603.

The operations of block 1601 comprise printing an image. This may be a test image or any other image, similar to block 1502 as described above.

The operations of block 1602 comprise determining an amount of edge blur in the printed image. This may involve obtaining an electronic image of the printed image, for example by scanning or photographing the printed image, similar to block 1502 as described above.

Block 1603 comprises adjusting a timing associated with supplying makeup air by an air supply unit based on the determined amount of edge blur. For example, the amount of edge blur may be used as feedback in a control loop, such as a PID control loop, with the timing being the controlled variable. Each air supply unit may have two timings that need to be set: a timing of starting the supply of the makeup air and the timing that supply of the makeup air ceases.

These timings may be determined separately by repeating the process 500, once for the start timings and once for the end timings. It should be understood that the start and end timings are determined based on the location of the print media, as described above. Specifically, the start and end timings correspond to the timings when the relevant parts of the print media reach corresponding trigger locations. Thus, adjusting the start and end timings is accomplished by adjusting the associated trigger locations.

In other embodiments, the method 1600 may be performed individually for each air supply unit. Thus, in such examples, the method 1600 may be performed 2N times, where N is the number of air supply units (once for start timings and once for end timings, for each air supply unit).

In some embodiments, the timings of a group of similarly-situated air supply units may be set to the same levels, meaning the same trigger locations are used for each of the similarly-situated air supply units relative to their respectively corresponding printheads or printhead modules. For example, if the start timing of one air supply unit is set to a location 1 mm upstream of its printhead, the start timing of the other similarly-situated air supply units may also be set to locations 1 mm upstream of their respective printheads. Thus, in such examples, the method 1600 may be performed for one member of a group of similarly situated air supply units, but does not need to be performed for the other members of that group. In some examples, groups of similar situated air supply units may include a group comprising all upstream air supply units and a group comprising all downstream air supply units. In another example, air supply units that are arranged in a similar position within their print module (e.g., front inboard side) may be considered as being part of the same group of similarly situated air supply units.

Figure 17:
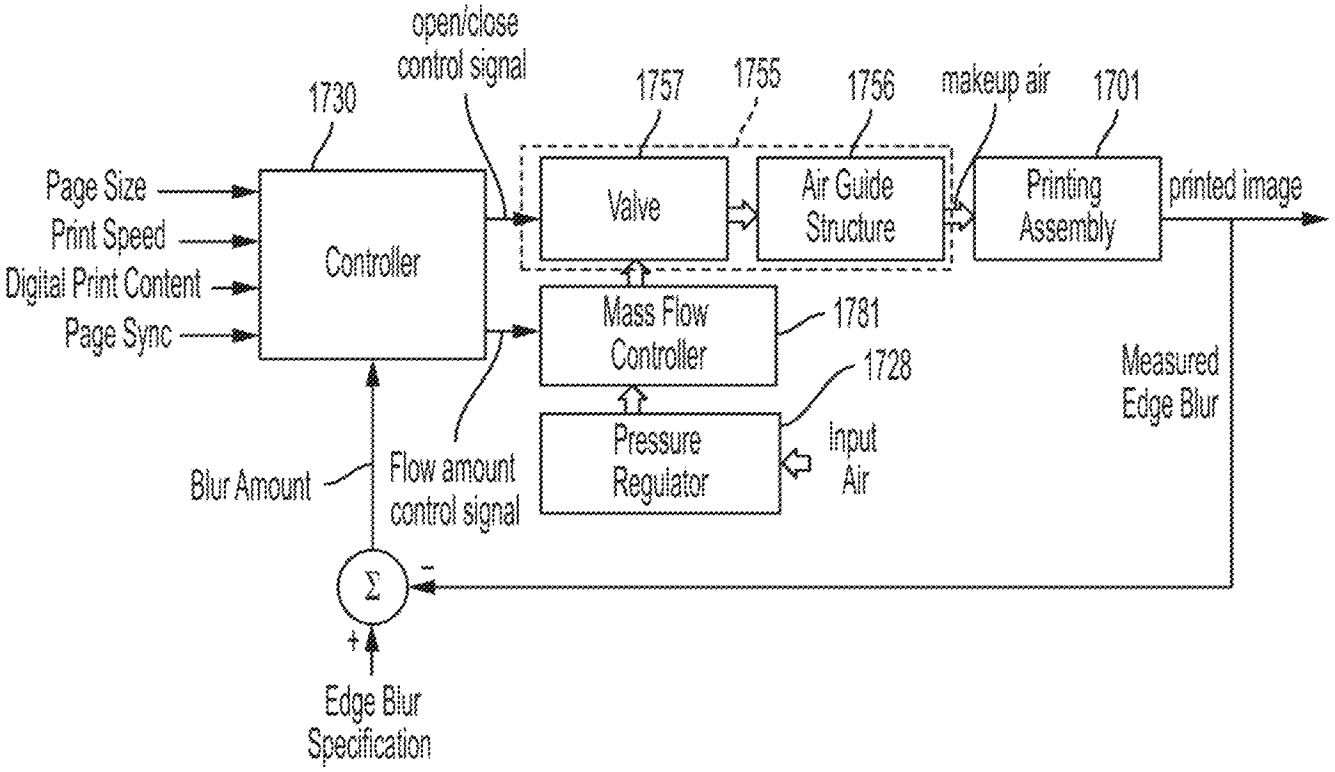
FIG. 17 is a block diagram illustrating a control loop for controlling an airflow control system.

FIG. 17 is a block diagram illustrating a control loop for a controller 730 controlling the amount of makeup air supplied and/or the timings at which the makeup air is supplied from an air supply unit 1755. The air supply unit 1755 may be used as any of the air supply units described herein. The controller 1730 may be used as, or as part of, the control system 130. The controller 1730 controls the amount of makeup air supplied by the air supply unit 1755 by sending a flow amount control signal to a mass flow controller 1781 associated with the air supply unit 1755. The mass flow controller 1781 receives pressurized air from a pressure regulator 1728, such as a fan, and adjusts a rate of airflow to the air supply unit 1755 based on the flow amount control signal. For example, the mass flow controller 1781 may comprise a device that changes an airflow impedance between the pressure regulator 1728 and the valve 1757, thereby controlling a rate of airflow. The controller 1730 controls the timings at which makeup air are supplied by sending an open/close control signal to a valve 1757 of the air supply unit 1755. In an open state, the valve 1757 allows air to flow from the mass flow controller 1781 to the air guide structure 1756, which in turn supplies the air as makeup air. In a closed state, the valve 1757 prevents air from flowing to the air guide structure 1756, thus preventing the supply of makeup air. The valve 1757 is configured to transition to the open state when an open command is received and to transition to the closed state when a close command is received. Thus, by varying the timings at which open and close commands are sent to the valve 1757, the controller 1730 controls the timings at which makeup air is supplied.

As shown in FIG. 17, an ink deposition assembly 1701 prints an image, and the amount of edge blur is measured in the printed image and fed back to the controller 1730. The measurement of the amount of image blur may be obtained in the manner described above. Based on the blur amount, the controller 1730 adjusts the amount of makeup air to be provided and/or the timing of providing the makeup air based on the blur feedback. As shown in FIG. 17, in some embodiments the measured amount of image blur is combined with (e.g., subtracted from) an edge blur specification. The edge blur specification is a parameter which indicates an amount of detected blur that would be considered acceptable by the system (since zero blur may not be feasible or desired in all circumstances). The edge blur specification may be a fixed value, or it may be a changeable parameter (e.g., user-selectable). The blur amount resultant from combining the measured edge blur and the edge blur specification is fed back into the controller 1730, and the controller 1730 determines whether (and by how much) to adjust the airflow rate and/or timings based on the blur amount. If the measured edge blur exceeds the edge blur specification, then corrective action is taken by adjusting airflow rate and/or timings. If the measured edge blur does not exceed the edge blur specification, then the controller 1730 may abstain from further adjustments to the airflow rate and/or timings. In other embodiments, the measured blur amount is fed back directly to the controller 1730. The controller 1730 may also receive additional inputs which are used to control the amounts and/or timings of the makeup air. For example, as illustrated in FIG. 17, the controller 1730 may receive an indication of a page size, a print speed, and a page sync timing, which the controller 1730 may use to determine the locations of the inter-media zones, and hence the timings for supplying makeup air. The controller 1730 may also receive information about the digital print content, which the controller 1730 may use as part of measuring the amount of edge blue, as already described above.

In some embodiments, the controller 1730 may also dynamically adjust the flow rate of the makeup air while the makeup air is being supplied based on the location of the inter-media zone. Specifically, the flow rate of a given air supply unit 1751 may be varied based on the proportion of the inter-media zone that is currently under the printhead (or in the deposition region of the printhead) corresponding to that given air supply unit 1751. Thus, when a relatively small proportion of the inter-media zone is under the printhead, such as when the inter-media zone first arrives at the printhead (e.g., the state illustrated in FIG. 3A), the controller 1730 may control the flow rate to be relatively low. As the inter-media zone continues to move downstream, more of the inter-media zone comes under the printhead (e.g., see the state illustrated in FIG. 3B), and thus the controller 1730 progressively increases the flow rate of the makeup air. When the largest proportion of the inter-media zone is under the printhead (e.g., the state illustrated in FIG. 3C), the controller 1730 may control the flow rate to a highest level. As the inter-media zone continues to move downstream, less of the inter-media zone will be under the printhead, and thus the controller 1730 will progressively decrease the flow rate.

Although in the description above the control of the flow rate is described as being based on the location of the inter-media zone, with the rate varying according to the proportion of the inter-media zone that is under the printhead, the location of the inter-media zone and the proportion thereof that is under the printhead are defined by the locations of the print media. Thus, the control described above may equivalently be described as the flow rate being controlled based on the location of the print media. Furthermore, the proportion of the inter-media zone that is located under the printhead (or in the deposition region) is inversely related to the surface area of the print medium that is under the printhead (or in the deposition region)—the more of the inter-media zone that is under the printhead, the smaller the area of the print medium that is under the printhead, and vice-versa. Thus, the varying of the flow rate based on the proportion of the inter-media zone that is under the printhead (or in the deposition region) can be equivalently described as varying the flow rate based on the surface area of the print medium that is under the printhead (or in the deposition region). Thus, controller 1730 may be configured to control an air supply unit 1751 to flow the air at a first flow rate when the print medium is at a first location relative to the printhead and to flow the air at a second flow rate, higher than the first flow rate, when the print medium is at a second location relative to the print head, wherein in a larger surface area of the print medium is in the deposition region in the first location than in the second location.

This description and the accompanying drawings that illustrate inventive aspects and embodiments should not be taken as limiting—the claims define the protected inventions, including equivalents. Various mechanical, compositional, structural, electrical, and operational changes may be made without departing from the spirit and scope of this description and the claims. In some instances, well-known circuits, structures, and techniques have not been shown or described in detail in order not to obscure the invention. Like numbers in two or more figures represent the same or similar elements.

Further, the terminology used herein to describe aspects of the invention, such as spatial and relational terms, is chosen to aid the reader in understanding example embodiments of the invention but is not intended to limit the invention. For example, spatial terms—such as "upstream", "downstream", "beneath", "below", "lower", "above", "upper", "proximal", "distal", "up", "down", and the like—may be used herein to describe directions or one element's or feature's spatial relationship to another element or feature as illustrated in the figures. These spatial terms are used relative to the poses illustrated in the figures, and are not limited to a particular reference frame in the real world. Thus, for example, the direction "up" in the figures does not necessarily have to correspond to an "up" in a world reference frame (e.g., away from the Earth's surface). Furthermore, if a different reference frame is considered than the one illustrated in the figures, then the spatial terms used herein may need to be interpreted differently in that different reference frame. For example, the direction referred to as "up" in relation to one of the figures may correspond to a direction that is called "down" in relation to a different reference frame that is rotated 180 degrees from the figure's reference frame. As another example, if a device is turned over 180 degrees in a world reference frame as compared to how it was illustrated in the figures, then an item described herein as being "above" or "over" a second item in relation to the Figures would be "below" or "beneath" the second item in relation to the world reference frame. Thus, the same spatial relationship or direction can be described using different spatial terms depending on which reference frame is being considered. Moreover, the poses of items illustrated in the figure are chosen for convenience of illustration and description, but in an implementation in practice the items may be posed differently.

The terms "upstream" and "downstream" refer to relative locations along a path that print media takes as it is transported through an ink deposition assembly. The path begins where the print media is introduced onto the movable support surface and ends where the print media leaves the support surface. When "upstream" is used to describe something this means that the thing is closer to the beginning of the path as compared to another location or element. Conversely, when "downstream" is used to describe something this means that the element is closer to the end of the path as compared to another location or element. The other location or element to which the thing is compared may be explicitly stated (e.g., "an upstream side of a printhead"), or it may be inferred from the context. Specifically, the air supply units may be arranged in pairs, with an upstream air supply unit of the pair being disposed upstream relative to a downstream air supply unit of the pair. Moreover, a pair of air supply units may be associated with a printhead or printhead module, and the upstream air supply unit of the pair may be arranged upstream of the printhead or printhead module while the downstream air supply unit of the pair may be arranged downstream of the printhead or printhead module.

The terms "inboard" and "outboard" refer to opposite sides of the media transport device along a cross-process direction. "Outboard" refers to the side of the media transport device closest to a registration location to which the edges of the print media are registered. For example, in FIGS. 5, 11, and 13, the outboard side of the media transport device corresponds to a right side of the device in the perspective of FIGS. 5, 11, and 13. "Inboard" refers to the side of the media transport device opposite from the outboard side. For example, in FIGS. 5, 11, and 13, the inboard side of the media transport device corresponds to a left side of the device in the perspective of FIGS. 5, 11, and 13. The terms "inboard" and "outboard" are also used to refer to directions, with "inboard" referring to a cross-process direction that points from the outboard side to the inboard side (e.g., leftward in FIGS. 5, 11, and 13) and "outboard" referring to the cross-process direction that points from the inboard side to the outboard side (e.g., rightward in FIGS. 5, 11, and 13). The terms "inboard" and "outboard" are also used to refer to relative locations or positions, with inboard being used to refer to a position that is further inboard than some other reference location and outboard being used to refer to a position that is further outboard than some other reference location. Thus, for example, an inboard side of a carrier plate refers to a side of the carrier plate that is relatively closer to the inboard side of the media transport device as compared to another side of the carrier plate.

The term "vacuum" has various meanings in various contexts, ranging from a strict meaning of a space devoid of all matter to a more generic meaning of a relatively low pressure state. Herein, the term "vacuum" is used in the generic sense, and should be understood as referring broadly to a state or environment in which the air pressure is lower than that of some reference environment, such as ambient or atmospheric pressure. The amount by which the pressure of the vacuum environment should be lower than that of the reference environment to be considered a "vacuum" is not limited, and may be a small amount or a large amount. Thus, "vacuum" as used herein may include, but is not limited to, states that might be considered a "vacuum" under the more strict senses of the term.

The term "air" has various meanings in various contexts, ranging from a strict meaning of the atmosphere of the Earth (or a mixture of gases whose proportions is similar to that of the atmosphere of the Earth), to a more generic meaning of any mixture of gases. Herein, the term "air" is used in the generic sense, and should be understood as referring broadly to any gas or mixture of gases. This may include, but is not limited to, the atmosphere of the Earth, an inert gas or mixture such as a gas or mixture comprising one of the Noble gases (e.g., Helium, Neon, Argon, etc.), Nitrogen ($N_2$) gas, or any other desired gas.

In addition, the singular forms "a", "an", and "the" are intended to include the plural forms as well, unless the context indicates otherwise. And, the terms "comprises", "comprising", "includes", and the like specify the presence of stated features, steps, operations, elements, and/or components but do not preclude the presence or addition of one or more other features, steps, operations, elements, components, and/or groups. Components described as coupled may be electrically or mechanically directly coupled, or they may be indirectly coupled via one or more intermediate components, unless specifically noted otherwise. Mathematical and geometric terms are not necessarily intended to be used in accordance with their strict definitions unless the context of the description indicates otherwise, because a person having ordinary skill in the art would understand that, for example, a substantially similar element that functions in a substantially similar way could easily fall within the scope of a descriptive term even though the term also has a strict definition.

Elements and their associated aspects that are described in detail with reference to one embodiment may, whenever practical, be included in other embodiments in which they are not specifically shown or described. For example, if an element is described in detail with reference to one embodiment and is not described with reference to a second embodiment, the element may nevertheless be claimed as included in the second embodiment.

What is claimed is:

1. A printing system, comprising:

a print fluid deposition assembly comprising:

a carrier plate comprising an opening;

a printhead supported by the carrier plate, wherein the printhead is arranged to eject a print fluid through the opening of the carrier plate and to a deposition region of the print fluid deposition assembly; and a media transport device comprising a movable support surface, the media transport device configured to hold a print medium against the movable support surface by vacuum suction and the movable support surface configured to transport the print medium along a process direction through the deposition region of the print fluid deposition assembly; and an airflow control system comprising an air supply unit arranged to flow air through the opening of the carrier plate between the carrier plate and the printhead, wherein the airflow control system is configured to control the air supply unit to selectively flow the air based on a location of a print medium transported by the media transport device relative to the printhead, and wherein the air supply unit comprises an air guide structure comprising an air outlet portion extending into the opening of the carrier plate between the printhead and the carrier plate, the air outlet portion terminating in an end wall that has a face angled obliquely relative to the movable support surface towards a reverse-process direction, the end wall defining one or more outlet openings in the face through which the air exits the air supply unit.

2. The printing system of claim 1, wherein the air guide structure further comprises:

an air inlet portion narrower than the air outlet portion in a cross-process direction, and a transitional portion between the air inlet portion to the air outlet portion, a width of the transitional portion increasing from the air inlet portion to the air outlet portion.

3. The printing system of claim 1, wherein:

the media transport device is configured to hold a plurality of print media, including the print medium, by vacuum suction against the movable support surface such that consecutive print media are spaced from each other via an inter-media zone, and the airflow control system is configured to selectively flow the air based on a location of the inter-media zone relative to the printhead.

4. The printing system of claim 1, wherein the air supply unit is one of a plurality of air supply units, the plurality of air supply units comprising:

an upstream air supply unit arranged to flow air at an upstream side of the printhead and a downstream air supply unit arranged to flow air at a downstream side of the printhead, wherein the airflow control system is configured to individually control the upstream air supply unit and the downstream air supply unit to selectively flow air, and wherein upstream and downstream are defined relative to the process direction.

5. The printing system of claim 4, wherein:

the media transport device is configured to hold a plurality of print media, including the print medium, against the movable support surface such that consecutive print media are spaced apart from each other via an inter-media zone, the airflow control system is configured to control the upstream air supply unit to supply the air when the inter-media zone reaches a first position relative to the printhead, and to cease supplying air when the inter-media zone reaches a second position relative to the printhead, and the airflow control system is configured to control the downstream air supply unit to supply the air when an inter-media zone reaches a third position relative to the printhead, and to cease supplying the air when the inter-media zone reaches a fourth position relative to the printhead.

6. The printing system of claim 5, wherein the first position is upstream of the second and third positions, and the second and third positions are upstream of the fourth position.

7. The printing system of claim 6, wherein the second position is the same as the third position.

8. The printing system of claim 5, wherein:

the print medium is a first print medium and wherein a second print medium of the plurality of print media consecutively follows and is upstream of the first print medium, and wherein lead and trail edges of the print media are defined based on the process direction through the deposition region, the first position corresponds to a trail edge of the first print medium being near the upstream side of the printhead, the second position corresponds to the lead edge of a second print medium being near the upstream side of the printhead, the third position corresponds to the trail edge of the first print medium being near a downstream side of the printhead, and the fourth position corresponds to the lead edge of the second print medium being near the downstream side of the printhead.

9. The printing system of claim 1, wherein:

the air supply unit comprises an air source configured to selectively supply the air to an air inlet portion of the air guide structure.

10. The printing system of claim 9, wherein:

the air supply unit further comprises a controllable valve configured to selectively control a supply of air from the air source to the air outlet portion of the air guide structure.

11. The printing system of claim 9, wherein the air source comprises a fan.

12. The printing system of claim 1, wherein the movable support surface comprises a belt with holes through the belt.

13. The printing system of claim 1, further comprising:

a control system configured to automatically control the airflow control system to selectively flow the air based on a monitored amount of image blur in printed images.

14. The printing system of claim 1, wherein the air guide structure is attached to the printhead.

15. The printing system of claim 14, wherein the air guide structure is removably attached to the printhead.

16. A printing system comprising:

a print fluid deposition assembly comprising:

a carrier plate comprising an opening;

a printhead supported by the carrier plate, wherein the printhead is arranged to eject a print fluid through the opening of the carrier plate and to a deposition region of the print fluid deposition assembly; and a media transport device comprising a movable support surface, the media transport device configured to hold a print medium against the movable support surface by vacuum suction and the movable support surface configured to transport the print medium along a process direction through the deposition region of the print fluid deposition assembly; and an airflow control system comprising an air supply unit arranged to flow air through the opening of the carrier plate between the carrier plate and the printhead, wherein the airflow control system is configured to control the air supply unit to selectively flow the air based on a location of a print medium transported by the media transport device relative to the printhead, and the air supply unit comprises an air guide structure removably attached to the printhead.

17. A method of operating a printing system, the method comprising:

transporting a print medium through a deposition region of a print fluid deposition assembly of the printing system, wherein the print medium is held against a moving movable support surface via vacuum suction during the transporting;

ejecting print fluid from a printhead of the print fluid deposition assembly through an opening in a carrier plate supporting the printhead to deposit the print fluid to the print medium in the deposition region; and controlling an airflow control system to selectively flow air through the opening in the carrier plate between the carrier plate and the printhead and to the movable support surface, wherein the controlling is based on a location of the print medium relative to the printhead, and wherein the selectively flowing the air comprises flowing the air through an air guide structure comprising an air outlet portion extending into the opening of the carrier plate between the printhead and the carrier plate and terminating in an end wall that has a face angled obliquely relative to the movable support surface toward a direction opposite a direction of the transporting, and flowing the air out of one or more outlet openings defined in the face.

18. The method of claim 17, wherein the air guide structure is attached to the printhead.

19. The method of claim 18, wherein the air guide structure is removably attached to the printhead.

20. The method of claim 17, wherein:

the air guide structure is one of a plurality of air guide structures comprising an upstream air guide structure located at an upstream side of the printhead and a downstream air guide structure located at a downstream side of the printhead, the transporting the print medium comprises transporting a plurality of print media, including the print medium, such that consecutive print media are spaced from each other by an inter-media zone, and controlling the airflow control system to selectively flow air comprises:

in response to the inter-media zone between the print media reaching a first position relative to the printhead, supplying the air through the opening in the carrier plate from the upstream air guide structure;

in response to the inter-media zone reaching a second position relative to the printhead, ceasing supplying the air from the upstream air guide structure;

in response to the inter-media zone reaching a third position relative to the printhead, supplying the air from the downstream air guide structure;

in response to the inter-media zone reaching a fourth position relative to the printhead, ceasing supplying the air from the downstream air guide structure, wherein upstream and downstream are defined relative to a direction of the transporting.

* * * * *